US011953201B2

(12) United States Patent
Karkow et al.

(10) Patent No.: US 11,953,201 B2
(45) Date of Patent: Apr. 9, 2024

(54) CONTROL SYSTEM AND METHOD FOR A BURNER WITH A DISTAL FLAME HOLDER

(71) Applicant: ClearSign Technologies Corporation, Tulsa, OK (US)

(72) Inventors: Douglas W. Karkow, Mount Vernon, IA (US); Donald Kendrick, Bellevue, WA (US); James K. Dansie, Seattle, WA (US); Christopher A. Wiklof, Everett, WA (US)

(73) Assignee: ClearSign Technologies Corporation, Tulsa, OK (US)

( * ) Notice: Subject to any disclaimer, the term of this patent is extended or adjusted under 35 U.S.C. 154(b) by 679 days.

(21) Appl. No.: 16/746,743

(22) Filed: Jan. 17, 2020

(65) Prior Publication Data

US 2020/0224873 A1 Jul. 16, 2020
US 2021/0164652 A9 Jun. 3, 2021

Related U.S. Application Data

(63) Continuation-in-part of application No. PCT/US2018/042935, filed on Jul. 19, 2018, and a (Continued)

(51) Int. Cl.
*F23D 14/82* (2006.01)
*F23D 14/22* (2006.01)

(Continued)

(52) U.S. Cl.
CPC ..... *F23D 14/825* (2013.01); *F23D 14/22* (2013.01); *F23D 14/32* (2013.01); *F23D 14/58* (2013.01);

(Continued)

(58) Field of Classification Search
CPC ..... F23D 14/825; F23D 14/58; F23N 5/242; F23N 5/006; F23N 5/003; F23R 3/18

(Continued)

(56) References Cited

U.S. PATENT DOCUMENTS 3,008,513 A 11/1961 Holden
4,483,673 A 11/1984 Murai et al.

(Continued)

FOREIGN PATENT DOCUMENTS

JP 2017-003216 1/2017
WO WO 1995/000803 1/1995

(Continued)

OTHER PUBLICATIONS

Anuradha M. Annaswamy and Ahmed F. Ghoniem, Active Control in Combustion Systems, Dec. 1995, IEEE (Year: 1995).*

(Continued)

*Primary Examiner* — Vivek K Shirsat
(74) *Attorney, Agent, or Firm* — Launchpad 1P, Inc.; Christopher A. Wiklof; Harold H. Bennett, II

(57) ABSTRACT

A combustion system includes a distal flame holder, a pilot fuel distributor, a main fuel distributor, an oxidant source, an array of sensors, and a controller. The oxidant source outputs an oxidant. The pilot fuel distributor supports a pilot flame configured to preheat the distal flame holder by outputting a pilot fuel at least when the combustion system is in a preheating state. The main fuel source outputs a main fuel in the standard operating state. The distal flame holder is configured to support a combustion reaction of the main fuel and the oxidant in the standard operating state. The sensors are configured to sense parameters of the pilot flame and the distal flame holder and to output sensor signals to the controller. The controller executes software instructions that (Continued)

include adjusting the flow of the main fuel, the pilot fuel, and the oxidant responsive to the sensor signals.

47 Claims, 16 Drawing Sheets

Related U.S. Application Data continuation-in-part of application No. 16/444,420, filed on Jun. 18, 2019, now Pat. No. 11,460,188, and a continuation-in-part of application No. 15/215,401, filed on Jul. 20, 2016, now Pat. No. 10,359,213, which is a continuation-in-part of application No. PCT/US2014/016622, filed on Feb. 14, 2014, and a continuation-in-part of application No. PCT/US2014/016632, filed on Feb. 14, 2014.

(60) Provisional application No. 62/534,193, filed on Jul. 18, 2017, provisional application No. 61/931,407, filed on Jan. 24, 2014, provisional application No. 61/765,022, filed on Feb. 14, 2013.

(51) Int. Cl.

| | |
|---|---|
| ***F23D 14/32*** | (2006.01) |
| ***F23D 14/58*** | (2006.01) |
| ***F23N 5/00*** | (2006.01) |
| ***F23N 5/24*** | (2006.01) |
| ***F23R 3/18*** | (2006.01) |

(52) U.S. Cl.
CPC ..... *F23N 5/242* (2013.01); *F23N 5/006* (2013.01); *F23R 3/18* (2013.01)

(58) Field of Classification Search
USPC ..... 431/346
See application file for complete search history.

(56) References Cited

U.S. PATENT DOCUMENTS 4,588,373 A 5/1986 Tonon et al.
4,643,667 A 2/1987 Fleming
4,673,349 A 6/1987 Abe et al.
4,726,767 A 2/1988 Nakajima
4,752,213 A 6/1988 Grochowski et al.
4,773,847 A 9/1988 Shukla et al.
4,850,862 A 7/1989 Bjerklie
5,235,667 A 8/1993 Canfield et al.
5,375,999 A 12/1994 Aizawa et al.
5,409,375 A 4/1995 Butcher
5,439,372 A 8/1995 Duret et al.
5,498,154 A 3/1996 Velie et al.
5,511,974 A 4/1996 Gordon et al.
5,577,905 A 11/1996 Momber et al.
5,641,282 A 6/1997 Lee et al.
5,654,868 A 8/1997 Buer
5,899,686 A 5/1999 Carbone et al.
5,927,963 A * 7/1999 Wolcott ..... F23N 5/20 431/264
5,993,192 A 11/1999 Schmidt et al.
6,129,545 A 10/2000 Kahlke et al.
6,140,658 A 10/2000 Jarvinen
6,159,001 A 12/2000 Kushch et al.
6,190,160 B1 * 2/2001 Hibon ..... F23L 7/007 431/12
6,270,336 B1 8/2001 Terashima et al.
6,389,330 B1 * 5/2002 Khesin ..... F23N 5/003 431/14
6,429,020 B1 * 8/2002 Thornton ..... F23N 5/08 422/89
6,561,793 B1 5/2003 Narasimhan
6,997,701 B2 2/2006 Volkert et al.
7,944,678 B2 5/2011 Kaplan et al.
8,282,389 B2 10/2012 Dhulst et al.
2003/0003590 A1 1/2003 Abbasi et al.
2003/0054313 A1 3/2003 Rattner et al.
2004/0058290 A1 3/2004 Mauzey et al.
2004/0063054 A1 * 4/2004 Cain ..... F23N 5/242 431/12
2005/0092851 A1 * 5/2005 Troost ..... F23N 5/082 236/91 B
2006/0084017 A1 4/2006 Huebner et al.
2007/0020567 A1 1/2007 Branston et al.
2007/0186872 A1 8/2007 Shellenberger et al.
2008/0124666 A1 5/2008 Stocker et al.
2009/0053664 A1 2/2009 Staller et al.
2009/0098492 A1 * 4/2009 Chiu ..... F23G 5/50 431/24
2011/0085030 A1 4/2011 Poe et al.
2011/0111356 A1 5/2011 Claerbout et al.
2011/0277706 A1 * 11/2011 Arnold ..... F24H 1/205 122/14.1
2012/0135360 A1 * 5/2012 Hannum ..... F23D 14/78 239/132.3
2012/0231398 A1 9/2012 Carpentier et al.
2013/0230811 A1 9/2013 Goodson et al.
2013/0291552 A1 11/2013 Smith et al.
2014/0080072 A1 * 3/2014 Smirnov ..... F23D 14/66 431/6
2015/0226424 A1 8/2015 Breidenthal et al.
2015/0276212 A1 10/2015 Karkow et al.
2015/0276213 A1 * 10/2015 Karkow ..... F23C 99/001 431/328
2015/0276220 A1 10/2015 Karkow et al.
2015/0316261 A1 11/2015 Karkow et al.
2015/0345780 A1 12/2015 Krichtafovitch
2015/0362178 A1 12/2015 Karkow et al.
2015/0369477 A1 12/2015 Karkow et al.
2016/0091200 A1 3/2016 Colannino et al.
2016/0153656 A1 6/2016 Kimura et al.
2016/0161115 A1 * 6/2016 Krichtafovitch ..... F23D 14/84 431/253
2016/0273764 A1 9/2016 Colannino et al.
2016/0290639 A1 10/2016 Karkow et al.
2016/0298836 A1 10/2016 Colannino et al.
2016/0298840 A1 10/2016 Karkow et al.
2016/0304343 A1 10/2016 Rutkowski et al.
2016/0305660 A1 10/2016 Colannino et al.
2016/0348899 A1 12/2016 Karkow et al.
2016/0348900 A1 12/2016 Colannino et al.
2016/0348901 A1 12/2016 Karkow et al.
2017/0010019 A1 1/2017 Karkow et al.
2017/0038064 A1 2/2017 Colannino et al.
2017/0089266 A1 * 3/2017 Alexander ..... F02C 9/34
2017/0307212 A1 10/2017 Kendrick
2018/0003378 A1 1/2018 Karkow et al.
2018/0017249 A1 1/2018 Karkow et al.
2018/0038588 A1 2/2018 Karkow et al.
2018/0066846 A1 3/2018 Karkow et al.
2018/0087774 A1 3/2018 Karkow et al.
2018/0202653 A1 7/2018 Karkow
2019/0107331 A1 4/2019 Kendrick et al.
2019/0137096 A1 5/2019 Kendrick et al.
2019/0257516 A1 8/2019 Karkow et al.
2019/0323707 A1 10/2019 Karnani et al.
2019/0390854 A1 12/2019 Karkow et al.
2020/0003413 A1 1/2020 Dansie et al.

(56) References Cited

U.S. PATENT DOCUMENTS

| | | | |
|---|---|---|---|
| 2020/0056782 | A1 | 2/2020 | Bucher et al. |
| 2020/0072467 | A1 | 3/2020 | Kendrick et al. |

FOREIGN PATENT DOCUMENTS

| | | |
|---|---|---|
| WO | WO 2015/123149 | 8/2015 |
| WO | WO 2017/048638 | 3/2017 |
| WO | WO 2019/018675 | 1/2019 |

OTHER PUBLICATIONS

PCT International Search Report and Written Opinion dated Nov. 6, 2018, for PCT International Patent Application No. PCT/US2018/042935 filed Jul. 19, 2018, 26 pages.

Extended European Search Report dated Jun. 18, 2019, for European Patent Application No. 19152400.8 filed Jan. 17, 2019, 8 pages.

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

Arnold Schwarzenegger, "A Low NOx Porous Ceramics Burner Performance Study," California Energy Commission Public Interest Energy Research Program, Dec. 2007, San Diego State University Foundation.

Isaksen, Øyvind; "Reconstruction Techniques for Capacitance Tomography," Meas. Sci. Technol., vol. 7, No. 3 (1996), pp. 325-337.

Liu, S., et al.; "Preliminary Study on ECT Imaging of Flames in Porous Media," Meas. Sci. Technol., vol. 19, No. 9 (2008), 7 pages.

B. Stratton et al., "Determining Flame Height and Flame Pulsation Frequency and Estimating Heat Release Rate from 3D Flame Reconstruction." Fire Engineering Research Report 05/2, Dept. of Civil Engineering, Univ. of Canterbury, Christchurch, New Zealand, Jul. 2005, 90 pages.

* cited by examiner

CONTROL SYSTEM AND METHOD FOR A BURNER WITH A DISTAL FLAME HOLDER

SUMMARY

Embodiments include a combustion system including a distal flame holder. The combustion system is configured to operate in a preheating state and in a standard operating state. In the preheating state, the combustion system supports a pilot flame with a pilot fuel and an oxidant. The pilot flame is positioned to heat the distal flame holder to an operating temperature. In the standard operating state, the distal flame holder holds a combustion reaction of a main fuel and an oxidant. Optionally, the main fuel and the pilot fuel may be the same fuel. According to some embodiments, the main fuel and/or the pilot fuel may include fuel mixtures. In an embodiment, the main fuel and the pilot fuel are natural gas.

According to an embodiment, a combustion system includes a pilot flame sensor configured to sense a condition of the pilot flame and to output sensor signals indicative of the condition of the pilot flame. The combustion system includes a distal flame holder sensor configured to sense a condition of the distal flame holder or a combustion reaction held by the distal flame holder and to output sensor signals indicative of the condition of the distal flame holder or the combustion reaction. The combustion system includes a controller configured to receive the sensor signals from the pilot flame sensor and the distal flame holder sensor. The controller is configured to execute software instructions stored on a non-transitory computer readable medium to automatically adjust parameters of the combustion system and to automatically transition the combustion system between the preheating state and the standard operating state responsive to the sensor signals from the distal flame holder sensor and the pilot flame sensor and/or to engage alternate methods or devices to maintain stable and safe combustion or stable and safe states other than the preheating state and the standard operating state. The controller adjusts the combustion system and transitions between states by controlling one or more actuators configured to adjust components of the combustion system.

According to an embodiment, a flame stability sensor is positioned to sense a flame condition (e.g., the presence or absence of a flame) in a region between (e.g., main) fuel nozzles and a distal (e.g., perforated) flame holder, said region being found by the inventors to characterize a main combustion reaction instability. For example, the flame stability sensor may be positioned halfway between the fuel nozzles and a distal flame holder, for example a perforated flame holder.

In an embodiment, a variable-output pilot burner may be positioned at least 0.62 of the distance from main fuel nozzles to a distal flame holder (the larger portion of the distance being between the main fuel nozzles and variable-output pilot burner). The variable output pilot burner may be driven to output a load corresponding to preheating of the distal flame holder or, alternatively, to output a continuous pilot. The inventors have found that by maintaining a continuous pilot flame adjacent to and below (subjacent, or upstream from) the distal flame holder, a transition step wherein a flame location is shifted between two discrete, different positions may be eliminated. In addition to, or advantageously instead of, the transition step, the continuous pilot is configured to hold a pilot flame according to a plurality of output loads. In an example system, the output loads principally used were two, either stable pilot flame or high output preheat flame where the temperature of the distal flame holder is raised to a main fuel operating temperature over a specified duration. The inventors contemplate that pluralities greater than two output levels may be used to maintain a very low, flame stability limited operation, a throttled system heat output mode (which in an embodiment may result in elimination of a second cold climate "HVAC" subsystem), a routine and minimum fuel pressure drop pre-heat mode, a demand pre-heat mode, and an emergent demand pre-heat mode. System damage recovery modes may one day prove advantageous. The inventors contemplate that a relatively high turndown ratio of the continuous pilot may be obtained by disposing a perforated or porous tile (pilot tile) superjacent to a plurality of 1 atm fuel nozzles, a low output pilot flame may be stabilized to minimize variable pilot stable heat output. In an embodiment, the system, at moderate to high output, supports low output stable pilot operation to cause greater than 98% of $CO_2$ generation is provided by main fuel nozzle during a normal operating mode. This mode may help reduce $NO_X$ production during normal operation compared to a higher ratio of pilot burner output to main fuel output.

The flame holder may include plural porous and/or solid bodies (tiles) with spaces therebetween.

A controller may, upon receipt of an instability signal from the flame stability sensor corresponding to at least transient presence of a flame in the positioned region, responsively execute a logical decision that the combustion reaction instability exists, at least transiently. The controller may responsively write an incident of the combustion reaction instability to a log file and/or cause an electronic display state corresponding to the incident to be provided to an operating engineer or the like. Optionally, the controller may cause one or more actuators to modify an operating condition to increase main combustion reaction stability. For example, the controller may cause actuation of a flame blow off apparatus to increase fluid flow velocity or fluid cooling between the fuel nozzles and the distal flame holder, cause a damper to open to increase air volume delivery, cause a blower to increase power to increase air volume delivery, cause a valve to momentarily pause fuel delivery, and/or cause increased pilot fuel output to increase combustion heat of the pilot flame.

One embodiment is a combustion system including a distal flame holder. The combustion system is configured to operate in a preheating state and in a standard operating state. In the preheating state, the combustion system supports a pilot flame by outputting a pilot fuel into a furnace volume. The pilot flame is positioned to heat the distal flame holder to an operating temperature. In the standard operating state, the distal flame holder holds a combustion reaction of a main fuel and an oxidant. The combustion system includes a pilot flame sensor configured to sense a condition of the pilot flame and to output sensor signals indicative of the condition of the pilot flame. The combustion system includes a distal flame holder sensor configured to sense a condition of the distal flame holder and to output sensor signals indicative of the condition of the distal flame holder. The combustion system includes a controller configured to receive the sensor signals from the pilot flame sensor and the distal flame holder sensor. The controller is configured to execute software instructions stored on a non-transitory computer readable medium to output messages on a display prompting an operator of the combustion system to adjust parameters of the combustion system and to transition the combustion system between the preheating state and the standard operating state responsive to the sensor signals from the distal flame holder sensor and the pilot flame sensor.

One embodiment is a combustion system including a distal flame holder. The combustion system is configured to operate in a preheating state and in a standard operating state. In the preheating state, the combustion system supports a pilot flame with a pilot fuel and an oxidant. The pilot flame is positioned to heat the distal flame holder to an operating temperature. In the standard operating state, the distal flame holder holds a combustion reaction of a main fuel and an oxidant. The combustion system includes a pilot flame sensor configured to sense a condition of the pilot flame and to output sensor signals indicative of the condition of the pilot flame. The combustion system includes a distal flame holder sensor configured to sense a condition of the distal flame holder and to output sensor signals indicative of the condition of the distal flame holder. The combustion system includes a controller configured to receive the sensor signals from the pilot flame sensor and the distal flame holder sensor. The controller is configured to execute software instructions stored on a non-transitory computer readable medium to adjust parameters of the combustion system and to transition the combustion system between the preheating state and the standard operating state responsive to the sensor signals from the distal flame holder sensor and the pilot flame holder sensor. The controller is configured to output messages on a display prompting an operator of the combustion system to approve adjusting parameters of the combustion system or transitioning between the preheating state and the standard operating state responsive to the sensor signals. The controller adjusts the combustion system and transitions between states by controlling one or more actuators configured to adjust components of the combustion system if the operator indicates approval of the adjustment or the transition. The controller can also maintain desired combustion within the distal flame holder via control of actuators in accordance with sensor signals output by the various sensors of the combustion system. Additionally, or alternatively, the controller may be configured to operate in an automatic mode wherein the controller automatically controls the one or more actuators. In the automatic mode, the controller preferably creates a log file to indicate sensed parameters and/or actuations performed under automatic control.

According to an embodiment, a computer method for operating a burner having a distal flame holder includes receiving a heat demand datum via a hardware digital interface operatively coupled to a network, and comparing, using a logic device and computer-readable non-transitory memory, the heat demand datum with previously received heat demand data. The computer method includes determining, with the logic device and the computer-readable non-transitory memory as a function of the heat demand datum, a heating state of a burner system including at least one distal flame holder and at least one continuous pilot apparatus. The computer method includes, responsive to an increase in the heat demand datum compared to previously received heat demand data, driving the burner system to place the continuous pilot apparatus into a high heat output state for a duration sufficient to raise the distal flame holder to a normal, main fuel, operating temperature. The computer method includes, after a main fuel operating state has been reached, ramping down the continuous pilot apparatus heat output while ramping up a main fuel flow through main fuel nozzles aligned to output fuel for entrainment in combustion air, then entering an input face of at least one tile of the distal flame holder.

DETAILED DESCRIPTION

Figure 1:
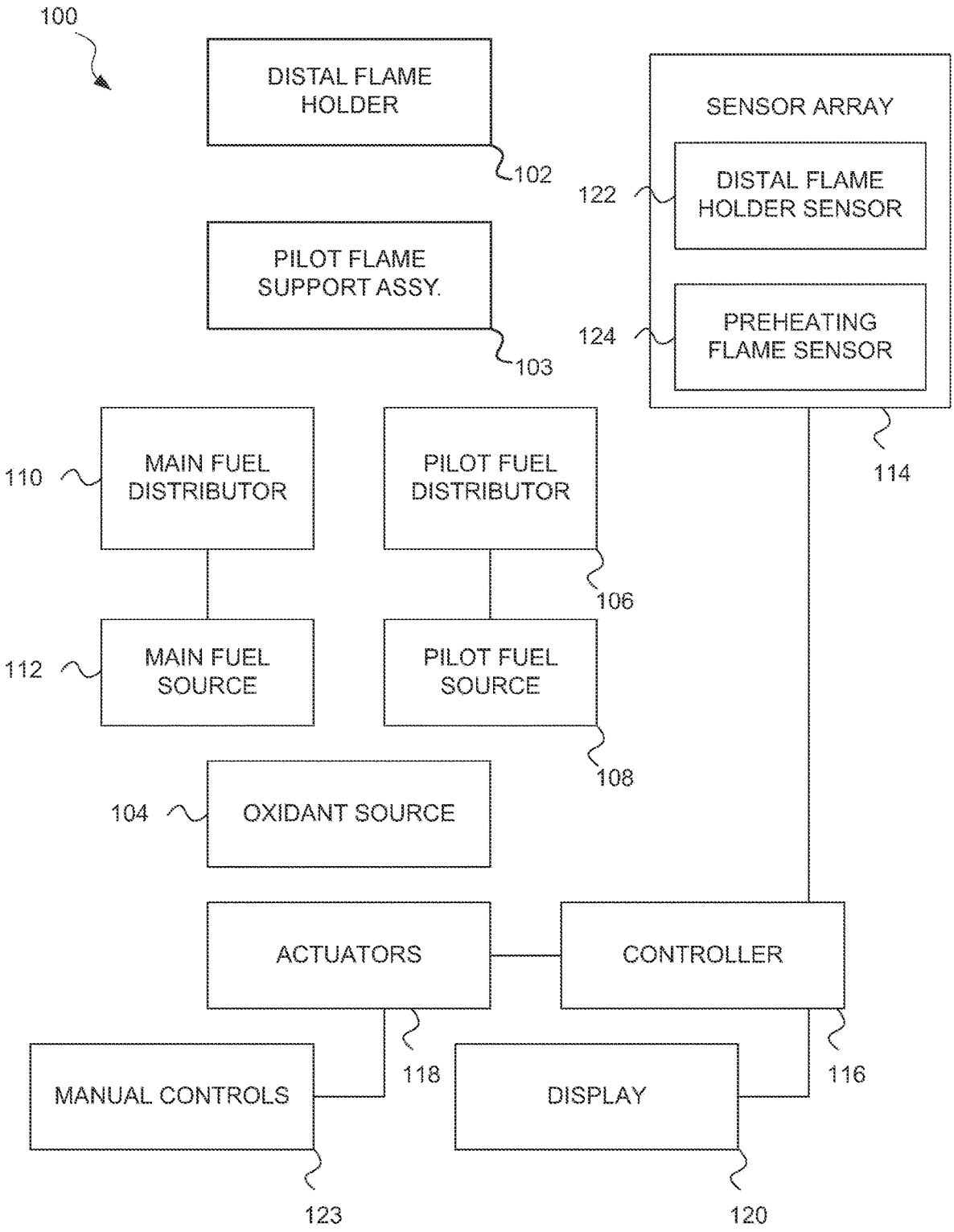
FIG. 1 is a block diagram of a combustion system including a distal flame holder, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram of a combustion system 100 including a distal flame holder 102, according to an embodiment. The combustion system 100 is configured to preheat the distal flame holder 102 to an operating temperature at which the distal flame holder 102 can sustain a combustion reaction of a main fuel and an oxidant at least partially within the distal flame holder 102. Thus, the combustion system 100 is configured to operate in two general operating conditions: a preheating state and a standard operating state. In the preheating state, the combustion system 100 preheats the distal flame holder 102 to the operating temperature. When the distal flame holder 102 has reached the operating temperature, the combustion system 100 transitions to the standard operating state in which the distal flame holder 102 holds a combustion reaction of the main fuel and the oxidant at least adjacent to the distal flame holder 102. In one embodiment, the distal flame holder 102 includes a perforated flame holder, and in the standard operating state the distal flame holder 102 holds a majority of the combustion reaction of the main fuel and the oxidant within the perforated flame holder.

In one embodiment, the combustion system 100 utilizes an oxidant source 104, a pilot fuel distributor 106 and a pilot fuel source 108 in at least the preheating state. In the preheating state, the oxidant source 104 outputs an oxidant into the furnace volume in which the distal flame holder 102 is positioned. The pilot fuel source 108 supplies a pilot fuel to the pilot fuel distributor 106. The pilot fuel distributor 106 outputs the pilot fuel into the furnace volume. The pilot fuel and the oxidant mix together in the furnace volume. In an embodiment, the combustion system 100 may utilize an igniter to ignite the mixture of the pilot fuel and the oxidant, thereby generating a pilot flame. The pilot flame is positioned between the pilot fuel distributor 106 and the distal flame holder 102. In an embodiment, the pilot flame may be positioned just upstream of the distal flame holder 102. In the preheating state, the pilot flame preheats the distal flame holder 102 until the distal flame holder 102 reaches the operating temperature. The terms pilot flame, preheat flame, and preheating flame may be used interchangeably throughout this disclosure, except where specifically noted. Specifically, when the pilot flame is engaged in a manner to preheat the distal flame holder 102, it is a preheating flame. When the distal flame holder 102 reaches the operating temperature, the combustion system 100 transitions to the standard operating state.

In one embodiment, in the standard operating state the combustion system 100 utilizes the main fuel distributor 110, the main fuel source 112, and the oxidant source 104 to support a combustion reaction of the main fuel and the oxidant at least adjacent to the distal flame holder 102 during the standard operating state. In the standard operating state, the main fuel source 112 supplies a main fuel to the main fuel distributor 110. The main fuel distributor 110 outputs the main fuel with a trajectory to be received by the distal flame holder 102. The main fuel and the oxidant mix as the main fuel travels toward the distal flame holder 102. The distal flame holder 102 receives the mixture of the main fuel and the oxidant at the distal flame holder 102. Because the distal flame holder 102 has been heated to the operating temperature, the distal flame holder 102 supports a combustion reaction of the main fuel and the oxidant supported by the distal flame holder 102.

According to an embodiment, the distal flame holder includes a perforated flame holder configured to support the combustion reaction of the main fuel and the oxidant at least partially within the perforated flame holder during the standard operating state. In another embodiment, the distal flame holder includes at least one refractory tile.

According to an embodiment, the combustion system 100 further includes an oxidant source configured to provide the oxidant to the furnace volume, and one or more actuators communicatively coupled to the controller configured to adjust a flow of the oxidant from the oxidant source. The controller may be configured to control the one or more actuators to adjust the flow of the oxidant responsive to the received sensor signals.

In an embodiment, the oxidant source may be a natural draft combustion air source. In another embodiment, the oxidant source may be a forced convection combustion air source.

In one embodiment, the oxidant source 104 includes multiple sources of oxidant. In the preheating state, the oxidant source 104 may supply oxidant from all sources of oxidant, e.g., through slots in a barrel register and from a common upstream supply. In the standard operating state, the barrel register can be closed so that all oxidant comes from upstream the slots of the barrel register.

In one embodiment, the oxidant source 104 includes dampers whose positions can be adjusted to direct all of the flow of the oxidant closer in proximity to a location of the main fuel distributors during the standard operating state and during transition to the standard operating state. During the preheating state, the position of the dampers can be adjusted to enable flow of the oxidant proximate to the pilot fuel distributors 106.

In one embodiment, various conditions can arise during the preheating state, the standard operating state, and the transition between the preheating state and the standard operating state. The conditions in the combustion system 100 can indicate that the preheating state is progressing normally, that the time to transition to the standard operating state has arrived, or that the combustion system 100 is operating as expected in the standard operating state. However, in some cases the conditions can indicate a problem with one or more components, processes, or operations of the combustion system 100. The conditions within the combustion system 100 can indicate that one or more parameters of the combustion system 100 should be adjusted in order to bring operations to a desired state, that the combustion system 100 should revert from a standard operating state to the preheating state, or that the combustion system 100 should shut down.

In one embodiment, the combustion system 100 utilizes a sensor array 114, a controller 116, actuators 118, and a display 120 in order to monitor and address the conditions within the combustion system 100. In particular, the sensor array 114 includes multiple sensors configured to sense various parameters of the combustion system 100. The sensors of the sensor array 114 can provide sensor signals to the controller 116. The controller 116 receives the sensor signals, identifies conditions within the combustion system 100, and controls the actuators 118 to adjust the conditions within the combustion system 100. The sensor signals can indicate that the preheating state is progressing normally, that the time to transition to the standard operating state has arrived, or that the combustion system 100 is operating as expected in the standard operating state. The sensor signals can also indicate a problem with the conditions or components of the combustion system 100. The controller 116 can adjust the components or the conditions of the combustion system 100 in response to the sensor signals by controlling the actuators 118 to physically adjust components or parameters of the combustion system 100. The display 120 can indicate the present conditions within the combustion system 100 in accordance with the sensor signals, can indicate that the controller 116 is taking one or more corrective actions, or can indicate that an operator of the combustion system 100 should operate one or more manual controls 123 in order to adjust conditions within the combustion system 100.

In one embodiment, the sensor array 114 includes a pilot flame sensor 124. The pilot flame sensor 124 senses parameters relating to the pilot flame during the preheating state of the combustion system 100. The pilot flame sensor 124 provides sensor signals to the controller 116 indicating the conditions of the pilot flame. Based on the sensor signals provided by the pilot flame sensor 124, the controller 116 can adjust parameters of the combustion system 100.

In one embodiment, the pilot flame sensor 124 detects whether the pilot flame is present during the preheating state. When the combustion system 100 enters the preheating state, the controller 116 controls one or more of the actuators 118 to cause the oxidant source 104 to output the oxidant into the furnace volume. The controller 116 can also control the actuators 118 to operate a valve or other mechanism enabling the pilot fuel source 108 to supply the pilot fuel to the pilot fuel distributor 106. The controller 116 can then cause an ignition mechanism (i.e., igniter), such as a sparker, to ignite the pilot fuel and the oxidant, thereby initiating the pilot flame. The pilot flame sensor 124 senses whether the pilot flame is present during the preheating state. The pilot flame sensor 124 provides sensor signals to the controller 116 indicating whether or not the pilot flame is present. If the sensor signals indicate that the pilot flame is not present, the controller 116 can take action such as causing the igniter to generate additional electric arcs in order to ignite the pilot fuel and the oxidant. If the pilot flame sensor 124 indicates that the pilot flame is still not present, then the controller 116 can control the actuators 118 to attempt to cause the oxidant source 104 to supply the oxidant or to attempt to cause the pilot fuel source 108 to supply the pilot fuel to the pilot fuel distributor 106. This can be followed by causing the igniter to generate additional electric arcs. If the sensor signals continue to indicate that the pilot flame is not present, the controller 116 can indicate that a system fault has occurred that requires that the combustion system 100 be shut down until an operator can inspect the oxidant source 104, the pilot fuel source 108, the pilot fuel distributor 106, the valves connecting the pilot fuel distributor 106 and the pilot fuel source 108, and the actuators 118 in order to identify and correct any faulty conditions with these components. The operator can then inspect the various components and correct any issues.

In one embodiment, the pilot flame sensor 124 may sense the position of the pilot flame in at least the preheating state. For example, the pilot flame may be present and may not be in a desired position. The sensor signal can indicate that the pilot flame is too close to the distal flame holder 102 or too far from the distal flame holder 102, i.e., too close to the pilot fuel distributor 106. In response to these conditions, the controller 116 can adjust the flow of the oxidant into the furnace volume by increasing or decreasing the flow of the oxidant into the furnace volume. In response to these conditions, the controller 116 can adjust the flow of the pilot fuel into the furnace volume by increasing or decreasing the flow rate of the pilot fuel, or by increasing or decreasing the velocity of the pilot fuel. By adjusting the flow of the oxidant and the pilot fuel, the controller 116 can adjust the position of the pilot flame relative to the distal flame holder 102.

In one embodiment, the pilot flame sensor 124 can indicate a temperature of the pilot flame. The pilot flame may be generating more or less heat than desired for the preheating of the distal flame holder 102. The sensor signals can inform the controller 116 of the temperature of the pilot flame. In response, the controller 116 can adjust the parameters of the flow of the oxidant and the pilot fuel in order to adjust the temperature of the pilot flame during the preheating state.

In one embodiment, the pilot flame sensor 124 can include multiple sensors. The pilot flame sensor 124 can include one or more of a flame scanner, a flame rod, a temperature sensor, an image capture device or other kinds of sensors for detecting the presence and parameters of the pilot flame. The pilot flame sensor 124 can include an electro-capacitive flame sensor. Structures and methods of using electro capacitive flame sensors are described in International Patent Application No. PCT/US2019/039467, entitled "VARIABLE COMPOSITION GAS MIXTURE SENSOR," filed Jun. 27, 2019, and International Patent Application No. PCT/US2019/039475, entitled "COMBUSTION SYSTEM INCLUDING A COMBUSTION SENSOR AND A PLASMA GENERATOR," filed Jun. 27, 2019, incorporated herein by reference thereto.

In one embodiment, the sensor array 114 can include a distal flame holder sensor 122. The distal flame holder sensor 122 can monitor parameters of the distal flame holder 102. The distal flame holder sensor 122 senses the parameters of the distal flame holder 102 during the preheating state and at least while entering the standard operating state. The distal flame holder sensor 122 generates sensor signals and provides them to the controller 116. The controller 116 receives the sensor signals from the distal flame holder sensor 122 and can take action to adjust the parameters of the combustion system 100 based on the conditions of the distal flame holder 102.

In one embodiment, the distal flame holder sensor 122 includes a temperature sensor configured to sense the temperature of the distal flame holder 102 during the preheating state. During the preheating state, the combustion system 100 supports a pilot flame positioned to heat the distal flame holder 102 to the operating temperature. Throughout the preheating state, the distal flame holder sensor 122 monitors the temperature of the distal flame holder 102. If the sensor signal indicates that the distal flame holder 102 has not yet reached the operating temperature, then the controller 116 keeps the combustion system 100 in the preheating state, thereby causing the pilot flame to continue to heat and increase the temperature of the distal flame holder 102. If the sensor signals indicate that the distal flame holder 102 has reached the operating temperature, then the controller 116 can cause the combustion system 100 to transition to the standard operating state.

In one embodiment, the controller 116 causes the combustion system 100 to transition to the standard operating state by removing the pilot flame. The controller 116 can remove the pilot flame by causing the actuators 118 to stop the pilot fuel source 108 from supplying the pilot fuel to the pilot fuel distributor 106. The controller 116 can cause the pilot fuel source 108 to stop providing the pilot fuel to the pilot fuel distributor 106 by closing one or more valves that connect the pilot fuel source 108 to the pilot fuel distributor 106. When the pilot fuel distributor 106 no longer outputs the pilot fuel, the pilot flame will be extinguished.

The controller 116 continues the transition from the preheating state to the standard operating state by causing the main fuel source 112 to supply the main fuel to the main fuel distributor 110 by controlling the actuators 118 to open one or more valves that enable the flow of the main fuel from the main fuel source 112 to the main fuel distributor 110. The main fuel distributor 110 outputs the main fuel into the furnace volume. The oxidant source 104 continues to output oxidant into the furnace volume during the transition to the standard operating state. The main fuel and the oxidant mix as they travel toward the distal flame holder 102. The distal flame holder 102 receives the mixture of the main fuel and the oxidant. Because the distal flame holder 102 has reached the operating temperature, the distal flame holder 102 outputs heat sufficient to ignite the mixture of the main fuel and the oxidant at the distal flame holder 102. In the standard operating state, the distal flame holder 102 supports a stable combustion reaction of the main fuel and the oxidant adjacent to or at least partially within the distal flame holder 102. In this way, the controller 116 can cause the transition of the combustion system 100 from the preheating state to the standard operating state responsive to the sensor signals from the distal flame holder sensor 122.

In one embodiment, the distal flame holder sensor 122 continues to monitor the distal flame holder 102 in the standard operating state and to output sensor signals to the controller 116. The distal flame holder sensor 122 can detect the presence or absence of the combustion reaction within and adjacent to the distal flame holder 102. If the distal flame holder sensor 122 indicates that the combustion reaction of the main fuel and the oxidant is not present at the distal flame holder 102, then the controller 116 can take corrective action. The controller 116 can cause the actuators 118 to adjust or reopen the valves that enable the flow of the main fuel from the main fuel source 112 to the main fuel distributor 110. The controller 116 can output a message on the display 120 indicating to the operator to check whether the main fuel source 112 is supplying the main fuel to the main fuel distributor 110 and to take corrective action, if necessary, by operating the manual controls 123. If, after the controller 116 has taken corrective actions, the distal flame holder sensor 122 indicates the absence of a combustion reaction of the main fuel and the oxidant, the controller 116 can cause the combustion system 100 to enter a fault state in which all fuel sources shut down so that neither the main fuel nor the pilot fuel is output into the furnace volume.

In one embodiment, the distal flame holder sensor 122 can indicate that the combustion reaction of the fuel and the oxidant is localized below the distal flame holder 102 or in an otherwise undesirable location. The controller 116 can take actions such as adjusting the flow of the main fuel, adjusting the output of the oxidant, or adjusting of the parameters of the components of the combustion system 100 in order to adjust the position of the combustion reaction of the main fuel and the oxidant. Alternatively, the controller 116 can output messages on the display 120 indicating to the operator of the combustion system 100 that the combustion reaction is not properly held by the distal flame holder 102 and that the operator should take corrective action.

In one embodiment, the distal flame holder sensor 122 can indicate that the temperature of the distal flame holder 102 has fallen below the operating temperature. In this case, the controller 116 can cause the combustion system 100 to reenter the preheating state. The controller 116 can cause the main fuel distributor 110 to again output the main fuel in order to reenter the standard operating state in which the distal flame holder 102 sustains a combustion reaction of the main fuel and the oxidant.

In one embodiment, the distal flame holder sensor 122 includes one or more of a flame scanner, a flame rod, a temperature sensor, a visible light sensor, an infrared light sensor, an ultraviolet light sensor, an image capture device that captures images in one or more of the visible light spectrum, the infrared light spectrum, or the ultraviolet light spectrum, or any other type of sensor that can detect parameters of a combustion reaction. The distal flame holder sensor 122 can include multiple sensors of the same type. The distal flame holder sensor 122 can include multiple sensors of different types, such as those set forth above. Thus, while FIG. 1 indicates a single distal flame holder sensor 122, the distal flame holder sensor 122 can include multiple individual sensors of different kinds or of the same kind.

In one embodiment, if neither the pilot flame sensor 124 nor the distal flame holder sensor 122 indicate the presence of a pilot flame or a main combustion reaction, the controller 116 can stop the flow of all fuel into the furnace volume.

In one embodiment, the pilot flame sensor 124 includes one or more of a flame scanner, a flame rod, a temperature sensor, a visible light sensor, an infrared light sensor, an ultraviolet light sensor, an image capture device that captures images in one or more of the visible light spectrum, the infrared light spectrum, or the ultraviolet light spectrum, or any other type of sensor that can detect parameters of a combustion reaction. The pilot flame sensor 124 can include multiple sensors of the same type. The pilot flame sensor 124 can include multiple sensors of different types, such as those set forth above. Thus, while FIG. 1 indicates a single pilot flame sensor 124, the pilot flame sensor 124 can include multiple individual sensors of different kinds or of the same kind.

In one embodiment, the sensor array 114 includes sensors other than the distal flame holder sensor 122 and the pilot flame sensor 124. For example, the sensor array 114 can include one or more of a bridge wall temperature sensor, a CO monitor, an $NO_X$ monitor, an $O_2$ monitor, a process monitor, a draft pressure sensor, a dynamic pressure sensor, a pressure differential sensor, or other kinds of sensors. Some of the sensors can be included in the distal flame holder sensor 122 or the pilot flame sensor 124. All the sensors of the sensor array 114 provide control signals to the controller 116. The controller 116 can take actions to adjust conditions in the combustion system 100 responsive to the sensor signals from the various sensors of the sensor array 114.

In one embodiment, the controller 116 includes a non-transitory computer readable medium and one or more processors. The non-transitory computer readable medium can include one or more memories and store instructions encoded in software for controlling the combustion system 100. The one or more processors are configured to execute the instructions. The instructions can include data related to the various operating conditions of the combustion system 100. The instructions can include data related to both faulty or undesirable operating conditions and proper or desirable operating conditions. The instructions can include actions to be taken by the controller 116 responsive to the sensor signals received by the controller 116. The actions can include adjusting conditions of the combustion system 100 by causing the actuators 118 to adjust, activate, or deactivate various components of the combustion system 100. The actions taken by the controller 116 can also include outputting messages to the display 120. The messages can include data indicating the current conditions of the combustion system 100. The messages can also include data prompting the operator of the combustion system 100 to take various actions in order to maintain or adjust the conditions of the combustion system 100. The messages can include prompts to approve an action proposed by the controller 116 to adjust or maintain conditions in the combustion system 100. The controller 116 can also output data via wired or wireless connections to one or more other computing systems. The data can include the data related to current conditions of the combustion system 100, the data related to actions taken by the controller 116, the data related to actions proposed by the controller 116, or prompts to the operator of the combustion system 100 to take actions or to approve proposed actions.

In one embodiment, the software instructions include one or more algorithms, state diagrams, decision trees, or other instructions by which the controller 116 makes decisions to adjust the parameters of the combustion system 100. The controller 116 can also include a state machine that determines actions to be taken by the controller 116 responsive to the sensor signals.

In one embodiment, the actuators 118 include mechanisms that can control, adjust, or otherwise affect physical components of the combustion system 100. The actuators 118 can include motors, motivators, electrical switches, electrical connectors, electrical transmitters, or other types of mechanisms that can physically affect or manipulate components of the combustion system 100. For example, the actuators 118 can include motors or switches for physically opening, closing, or otherwise adjusting valves that control the flow of fuel or oxidant into the furnace volume. The actuators 118 can include mechanisms that control the movements of a stack damper. The actuators 118 can include mechanisms that activate an igniter to ignite the pilot flame or the main combustion reaction. The actuators 118 can include mechanisms that adjust the mixture of fuels included in the pilot fuel or the main fuel by increasing or decreasing the concentration of various components of the pilot fuel or the main fuel. The actuators 118 can include mechanisms for adjusting or activating the oxidant source 104. The actuators 118 can include other kinds of mechanisms for physically manipulating components of the combustion system 100 other than those set forth above. These other kinds of mechanisms can also include mechanisms for controlling components of the combustion system 100 not shown in FIG. 1 or expressly described herein.

In one embodiment, the manual controls 123 enable the operator of the combustion system 100 to physically manipulate components of the combustion system 100 in order to adjust conditions of the combustion system 100. The manual controls 123 can include switches, buttons, dials, levers, keypads, touchscreens, keyboards, or other types of mechanisms that can enable the operator to manipulate the components of the combustion system 100. The manual controls 123 can include manual devices for opening and closing valves. The manual controls 123 can include the valves themselves. The manual controls 123 can enable the operator to activate, deactivate, or adjust the oxidant source 104, the main fuel source 112, the pilot fuel source 108, the main fuel distributor 110, the pilot fuel distributor 106, the igniter, the stack damper, or any other components of the combustion system 100.

In one embodiment, the manual controls 123 can control the actuators 118. The manual controls 123 can control some or all of the same actuators 118 that can be controlled by the controller 116. The manual controls 123 can also control actuators 118 that cannot be controlled by the controller 116. In some cases, the manual controls 123 include some or all of the actuators 118. In one embodiment, the manual controls 123 enable the operator to shut down the combustion system 100 entirely or to override actions taken by the controller 116.

According to embodiments, the distal flame holder 102 may be formed from perforated or porous tiles or bodies, from solid tiles or bodies, or from a combination of perforated and solid tiles or bodies. The inventors have found that a distal flame holder 102 using a combination of perforated and solid bodies has performance properties similar to and operates in a manner similar to a distal flame holder made exclusively of structural elements plus perforated tiles. The following description of FIGS. 2-4, while referring specifically to a distal flame holder 102 or a distal flame holder 102 including a perforated flame holder body 208, will be understood to also be applicable to distal flame holders that use perforated tiles, solid bodies spaced apart, or a combination of perforated tiles and solid bodies.

Figure 2:
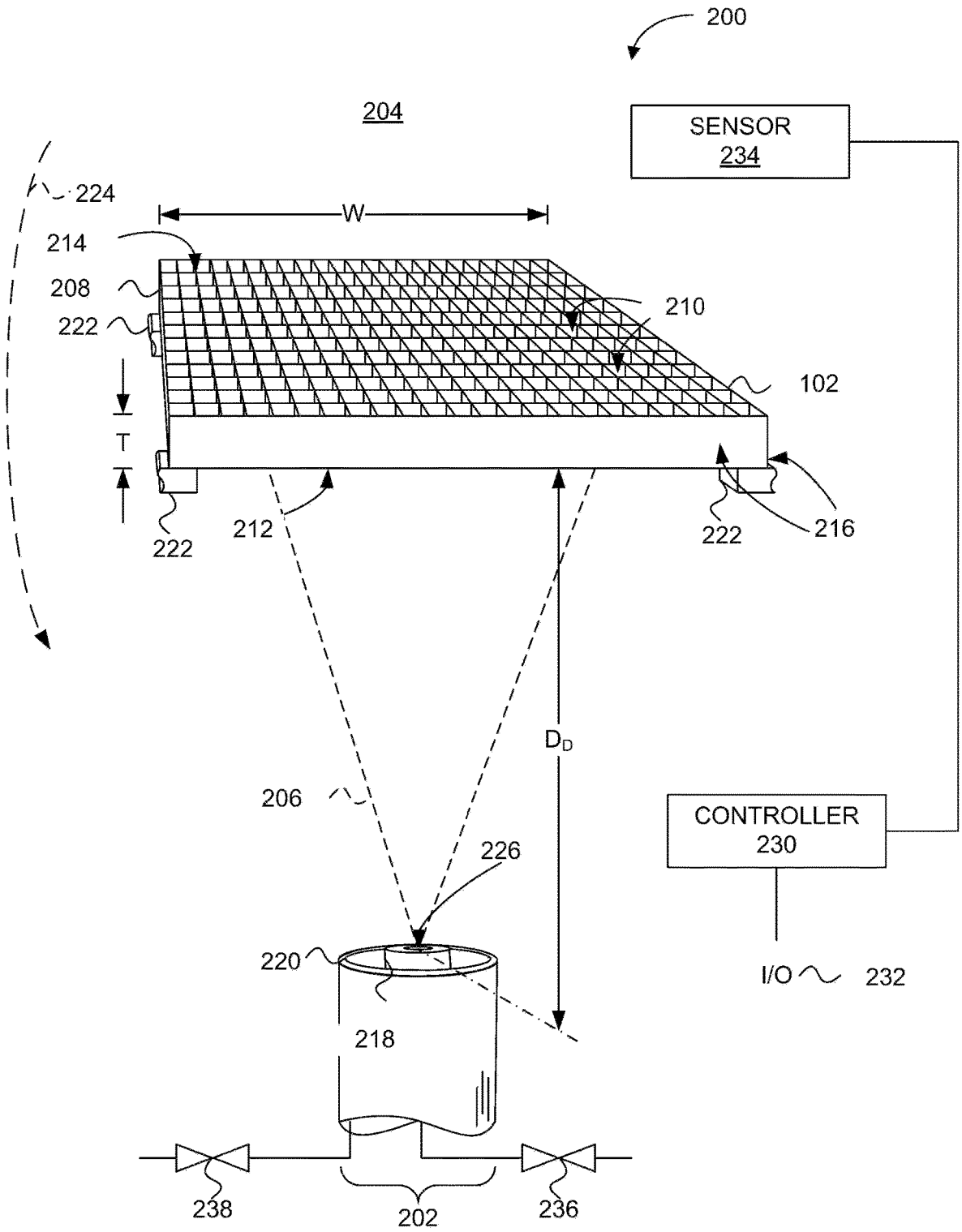
FIG. 2 is a simplified diagram of a combustion system including a distal flame holder configured to hold a combustion reaction, according to an embodiment.

FIG. 2 is a simplified diagram of a burner system 200 including a distal flame holder 102 configured to hold a combustion reaction, according to an embodiment. As used herein, the terms distal flame holder and distal reaction holder shall be considered synonymous unless further definition is provided. Likewise, the terms perforated flame holder, perforated reaction holder, porous flame holder, porous reaction holder, duplex, and duplex tile shall be considered synonymous unless further definition is provided. According to embodiments, the distal flame holder 102 may include a perforated flame holder.

Experiments performed by the inventors have shown that distal flame holders 102 described herein can support very clean combustion. Specifically, in experimental use of burner systems 200 ranging from pilot scale to full scale, output of oxides of nitrogen ($NO_X$) was measured to range from low single digit parts per million (ppm) down to undetectable (less than 1 ppm) concentration of $NO_X$ at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The distal flame holder 102 is disposed in the combustion volume 204 and positioned to receive the fuel and oxidant mixture 206.

Figure 3:
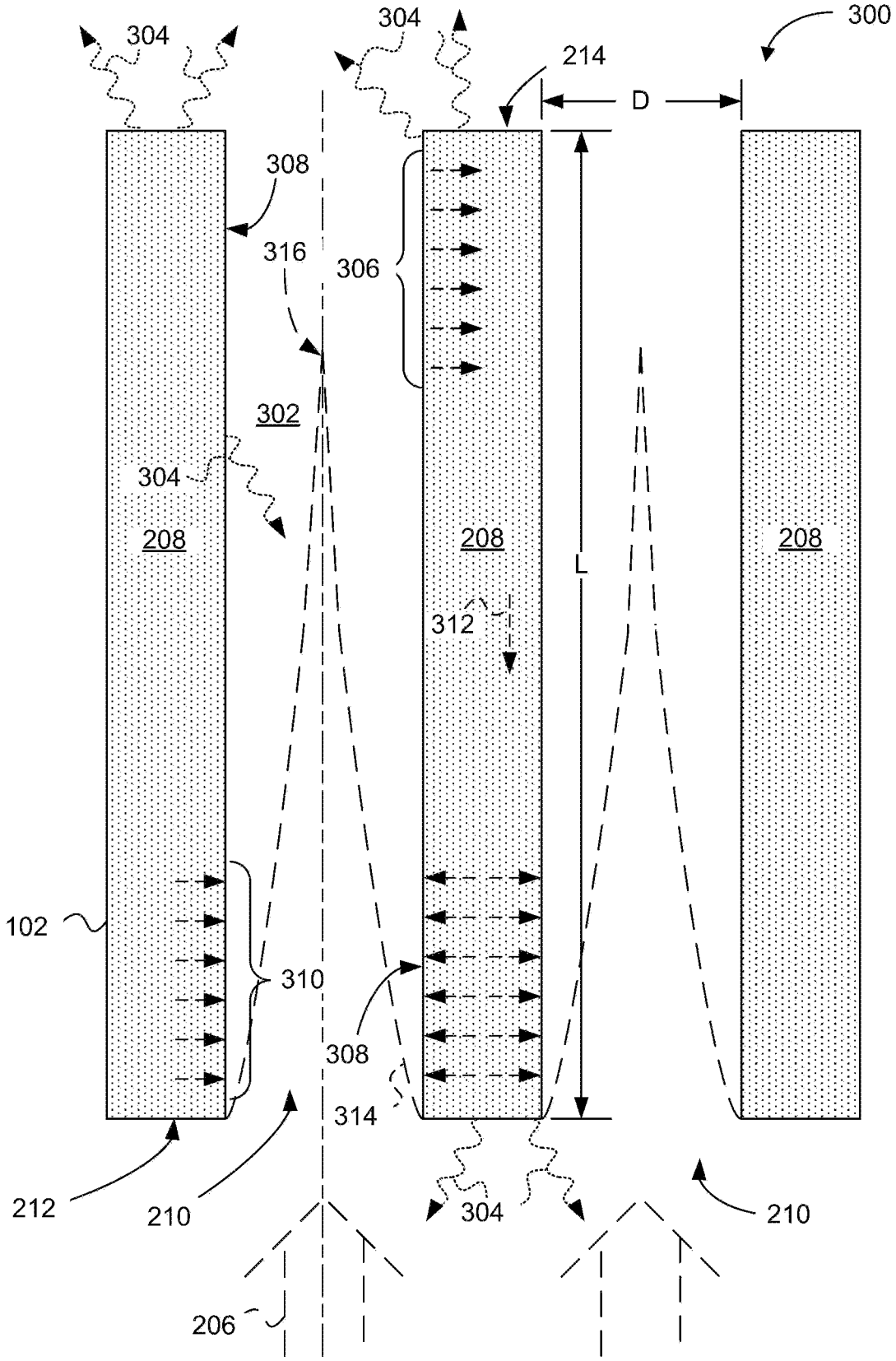
FIG. 3 is a side sectional diagram of a portion of the distal flame holder of FIGS. 1 and 2, according to an embodiment.

FIG. 3 is a side sectional diagram 300 of a portion of the distal flame holder 102 of FIGS. 1 and 2, according to an embodiment. Referring to FIGS. 2 and 3, a distal flame holder 102 may include a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of a perforated flame holder, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application, the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the distal flame holder 102 incorporating a perforated flame holder body 208. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the distal flame holder 102 incorporating a perforated flame holder body 208 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder. According to an alternative interpretation, more than half of the heat or thermal energy output by the combustion reaction 302 may be output between the input face 212 and the output face 214 of the distal flame holder 102 incorporating a perforated flame holder body 208. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the distal flame holder 102 incorporating a perforated flame holder body 208. In some experiments, the inventors produced a combustion reaction 302 that was apparently wholly contained in the perforations 210 between the input face 212 and the output face 214 of the distal flame holder 102 incorporating a perforated flame holder body 208. According to an alternative interpretation, the distal flame holder 102 incorporating a perforated flame holder body 208 can support combustion between the input face 212 and the output face 214 when combustion is "time-averaged." For example, during transients, such as before the distal flame holder 102 is fully heated, or if too high a (cooling) load is placed on the system, the combustion may travel somewhat downstream from the output face 214 of the distal flame holder 102 incorporating a perforated flame holder body 208. Alternatively, if the cooling load is relatively low and/or the furnace temperature reaches a high level, the combustion may travel somewhat upstream of the input face 212 of the perforated flame holder.

While a "flame" is described in a manner intended for ease of description, it should be understood that in some instances, no visible flame is present. Combustion occurs primarily within the perforations 210, but the "glow" of combustion heat is dominated by a visible glow of the distal flame holder 102 itself. In other instances, the inventors have noted transient "huffing" or "flashback" wherein a visible flame momentarily ignites in a region lying between the input face 212 of the distal flame holder 102 incorporating a perforated flame holder 208, and a fuel nozzle 218, within the dilution region $D_D$. Such transient huffing or flashback is generally short in duration such that, on a time-averaged basis, a majority of combustion occurs within the perforations 210 of the perforated flame holder, between the input face 212 and the output face 214. In still other instances, the inventors have noted apparent combustion occurring downstream from the output face 214 of the distal flame holder 102, but still a majority of combustion occurred within the perforated flame holder of the distal flame holder 102 as evidenced by continued visible glow from the distal flame holder 102 that was observed.

The distal flame holder 102 incorporating a perforated flame holder 208 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder of the distal flame holder 102 outputs another portion of the received heat to the fuel and oxidant mixture 206 received at the input face 212 of the perforated flame holder. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder of the distal flame holder 102 under other conditions. Most probably, there is no clearly defined edge of the heat receiving regions 306 (or for that matter, of heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to the heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the distal flame holder 102 may act as a heat source to maintain the combustion reaction 302, even under conditions where a combustion reaction 302 would not be stable when supported from a conventional flame holder.

The inventors believe that a distal flame holder 102 incorporating a perforated flame holder body 208 causes the combustion reaction 302 to begin within thermal boundary layers 314 formed adjacent to the walls 308 of the perforations 210. Insofar as combustion is generally understood to include a large number of individual reactions, and since a large portion of combustion energy is released within the distal flame holder 102 incorporating a perforated flame holder body 208, it is apparent that at least a majority of the individual reactions occur within the distal flame holder 102 incorporating a perforated flame holder body 208. As the relatively cool fuel and oxidant mixture 206 approaches the input face 212, the flow is split into portions that respectively travel through individual perforations 210. The hot perforated flame holder body 208 transfers heat to the fluid, notably within the thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and the output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the distal flame holder 102 incorporating a perforated flame holder body 208. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the distal flame holder 102 incorporating a perforated flame holder 208 if the length L of each perforation 210 is at least four times the transverse dimension D of the perforation 210. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for the thermal boundary layers 314 to form adjacent to the perforation walls 308 in a reaction fluid flowing through the perforations 210 to converge at the merger points 316 within the perforations 210 between the input face 212 and the output face 214 of the distal flame holder 102 incorporating a perforated flame holder body 208. In experiments, the inventors have found L/D ratios between 12 and 48 to work well (i.e., produce low $NO_X$, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include the fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The distal flame holder 102 can be held by a distal flame holder support structure 222 configured to hold the distal flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and the oxidant travel along a path to the distal flame holder 102 through the dilution distance $D_D$ between the fuel nozzle 218 and the distal flame holder 102. Additionally or alternatively (particularly when a blower is used to deliver the oxidant contained in combustion air), the oxidant or combustion air source 220 can be configured to entrain the fuel and the fuel and the oxidant travel through the dilution distance $D_D$. In some embodiments, a flue gas recirculation path 224 can be provided. Additionally, or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the distal flame holder 102.

The fuel nozzle 218 can be configured to emit the fuel through one or more fuel orifices 226 having an inside diameter dimension that is referred to as "nozzle diameter." The distal flame holder support structure 222 can support the distal flame holder 102 to receive the fuel and oxidant mixture 206 at the distance $D_D$ away from the fuel nozzle 218 greater than 20 times the nozzle diameter. In another embodiment, the distal flame holder 102 is disposed to receive the fuel and oxidant mixture 206 at the distance $D_D$ away from the fuel nozzle 218 between 100 times and 1100 times the nozzle diameter. Preferably, the distal flame holder support structure 222 is configured to hold the distal flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal $NO_X$.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the distal flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The distal flame holder support structure 222 can be configured to support the distal flame holder 102 from a floor or wall (not shown) of the combustion volume 204, for example. In another embodiment, the distal flame holder support structure 222 supports the distal flame holder 102 from the fuel and oxidant source 202. Alternatively, the distal flame holder support structure 222 can suspend the distal flame holder 102 from an overhead structure (such as a flue, in the case of an up-fired system). The distal flame holder support structure 222 can support the distal flame holder 102 in various orientations and directions.

The distal flame holder 102 can include a single perforated flame holder body 208. In another embodiment, the distal flame holder 102 can include a plurality of adjacent distal flame holder sections that collectively provide a tiled distal flame holder 102. In an embodiment, one or more of the plurality of adjacent distal flame holder sections may include a perforated flame holder body 208. In other embodiments, the distal flame holder 102 may include a plurality of distal flame holder sections disposed apart from each other at positions about a central flow axis of the fuel and the oxidant.

The distal flame holder support structure 222 can be configured to support the plurality of distal flame holder sections. The distal flame holder support structure 222 can include a metal superalloy, a cementatious, and/or a ceramic refractory material. In an embodiment, the plurality of adjacent distal flame holder sections can be joined with a fiber reinforced refractory cement.

The distal flame holder 102 can have a width dimension W between opposite sides of the peripheral surface 216 at least twice a thickness dimension T between the input face 212 and the output face 214. In another embodiment, the distal flame holder 102 can have a width dimension W between opposite sides of the peripheral surface 216 at least three times, at least six times, or at least nine times the thickness dimension T between the input face 212 and the output face 214 of the distal flame holder 102.

In an embodiment, the distal flame holder 102 can have a width dimension W less than a width of the combustion volume 204. This can allow the flue gas recirculation path 224 from above to below the distal flame holder 102 to lie between the peripheral surface 216 of the distal flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example, the plurality of perforations 210 can each have a lateral dimension D of about 0.2 to 0.4 inch.

The void fraction of a distal flame holder 102 that incorporates a perforated flame holder body 208 is defined as the total volume of all perforations 210 in a section of the perforated flame holder body 208 divided by a total volume of the perforated flame holder 102 including the perforated flame holder body 208 and the perforations 210. In such embodiments the distal flame holder 102 should have a void fraction between 0.10 and 0.90. In an embodiment, the distal flame holder 102 can have a void fraction between 0.30 and 0.80. In another embodiment, the distal flame holder 102 can have a void fraction of about 0.70. Using a void fraction of about 0.70 was found to be especially effective for producing very low $NO_X$.

A distal flame holder 102 incorporating the perforated flame holder body 208 can be formed from a fiber reinforced cast refractory material and/or a refractory material such as an aluminum silicate material. For example, the perforated flame holder body 208can be formed to include mullite or cordierite. Additionally, or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder body 208 can be formed from VERSAGRID® ceramic honeycomb, available from Applied Ceramics, Inc. of Doraville, South Carolina.

The perforations 210 can be parallel to one another and normal to the input and the output faces 212, 214. In another embodiment, the perforations 210 can be parallel to one another and formed at an angle relative to the input and the output faces 212, 214. In another embodiment, the perforations 210 can be non-parallel to one another. In another embodiment, the perforations 210 can be non-parallel to one another and non-intersecting. In another embodiment, the perforations 210 can be intersecting. The perforated flame holder body 208 can be one piece or can be formed from a plurality of sections.

In another embodiment, which is not necessarily preferred, the perforated flame holder body 208 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder body 208 may be formed from a ceramic material that has been punched, bored or cast to create channels.

In another embodiment, the perforated flame holder body 208 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g., Super Raschig Rings) that may be held together by a metal cage.

The inventors contemplate various explanations for why burner systems including the distal flame holder 102 provide such clean combustion.

According to an embodiment, a perforated flame holder body 208 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder body 208, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder body 208 and systems including the perforated flame holder body 208described herein were found to provide substantially complete combustion of CO (single digit ppm down to undetectable, depending on experimental conditions), while supporting low $NO_X$. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced $NO_X$ formation. In one embodiment, "slightly lean" may refer to 3% 02, i.e., an equivalence ratio of −0.87. Use of even leaner mixtures is possible, but may result in elevated levels of $O_2$. Moreover, the inventors believe the perforation walls 308 may act as a heat sink for the combustion fluid. This effect may alternatively or additionally reduce combustion temperatures and lower $NO_X$.

According to another interpretation, production of $NO_X$ can be reduced if the combustion reaction 302 occurs over a very short duration of time. Rapid combustion causes the reactants (including oxygen and entrained nitrogen) to be exposed to $NO_X$-formation temperature for a time too short for $NO_X$ formation kinetics to cause significant production of $NO_X$. The time required for the reactants to pass through the perforated flame holder body 208 is very short compared to a conventional flame. The low $NO_X$ production associated with perforated flame holder combustion may thus be related to the short duration of time required for the reactants (and entrained nitrogen) to pass through the perforated flame holder body 208.

Figure 4:
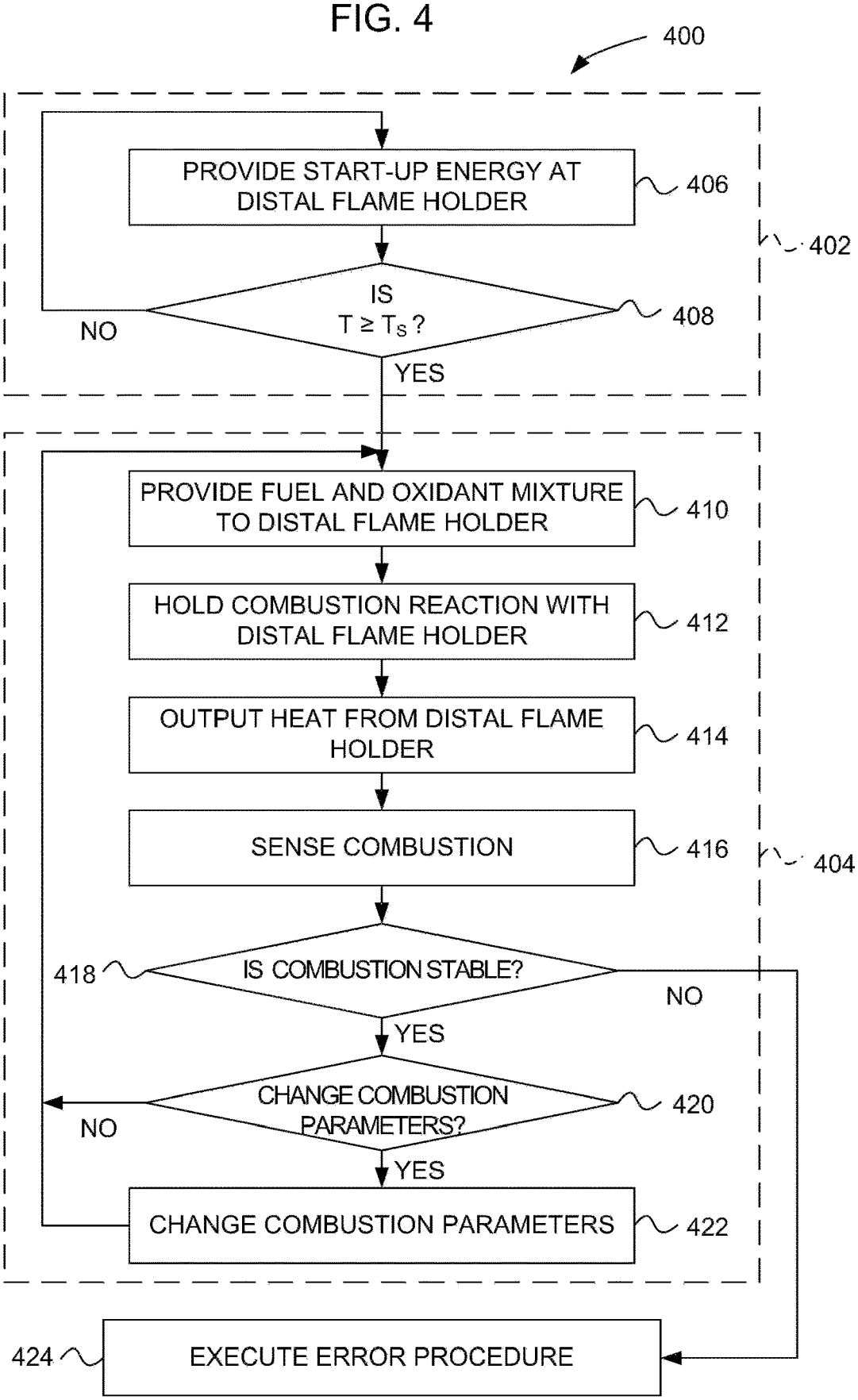
FIG. 4 is a flow chart showing a method for operating a burner system including the distal flame holder of FIGS. 1-3, according to an embodiment.

FIG. 4 is a flow chart showing a method 400 for operating a burner system including the distal flame holder 102 shown and described herein. To operate a burner system including a distal flame holder, the distal flame holder is first heated to a temperature sufficient to maintain combustion of the fuel and oxidant mixture.

According to a simplified description, the method 400 begins with step 402, wherein the distal flame holder (e.g., 102) is preheated to a start-up temperature, $T_S$. After the distal flame holder is raised to the start-up temperature, the method proceeds to step 404, wherein the fuel and oxidant are provided to the distal flame holder and combustion is held by the distal flame holder.

According to a more detailed description, step 402 begins with step 406, wherein start-up energy is provided at the distal flame holder. Simultaneously or following providing start-up energy, a decision step 408 determines whether the temperature T of the distal flame holder is at or above the start-up temperature, $T_S$. As long as the temperature of the distal flame holder is below its start-up temperature, the method loops between steps 406 and 408 within the preheat step 402. In decision step 408, if the temperature T of at least a predetermined portion of the distal flame holder is greater than or equal to the start-up temperature, the method 400 proceeds to overall step 404, wherein fuel and oxidant is supplied to and combustion is held by the distal flame holder.

Step 404 may be broken down into several discrete steps, at least some of which may occur simultaneously.

Proceeding from decision step 408, a fuel and oxidant mixture is provided to the distal flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the distal flame holder. The fuel may entrain the combustion air (or alternatively, the combustion air may dilute the fuel) to provide a fuel and oxidant mixture at the input face of the distal flame holder incorporating a perforated flame holder body 208 at a fuel dilution selected for a stable combustion reaction that can be held within the perforations of the perforated flame holder.

Proceeding to step 412, the combustion reaction is held by the distal flame holder.

In step 414, heat may be output from the distal flame holder. The heat output from the distal flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the distal flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the distal flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in decision step 418, combustion at the distal flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally, or alternatively, if the combustion system is in a start-up mode, then fuel and oxidant flow may be gradually increased to the distal flame holder over one or more iterations of the loop within step 404.

As described in conjunction with FIGS. 3 and 4, the distal flame holder 102 operates by outputting heat to the incoming fuel and oxidant mixture 206. After combustion is established, this heat is provided by the combustion reaction 302; but before combustion is established, the heat (or "startup energy," in FIG. 4) is provided by combustion of a mixture of pilot fuel from a pilot fuel distributor 106 and an oxidant.

In some embodiments, the pilot fuel distributor 106 may itself support a pilot flame the intensity of which is controlled to heat the distal flame holder 102. In other embodiments, the pilot fuel distributor 106 may include a flame holder configured to support a pilot flame disposed to heat the distal flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The distal flame holder 102 can be disposed to receive a diluted fuel and oxidant mixture 206 that supports a combustion reaction 302 that is stabilized by the distal flame holder 102 when the distal flame holder 102 is at an operating temperature. A start-up flame holder, in contrast, can be configured to support a start-up flame at a location corresponding to a relatively unmixed fuel and oxidant mixture that is stable without stabilization provided by the heated distal flame holder 102.

The burner system 200 can further include a controller 230 operatively coupled to the pilot fuel distributor 106 and to a data interface 232. For example, the controller 230 can be configured to control ignition, and change (e.g., turn up) a flow rate, of a pilot fuel provided by the pilot fuel distributor 106 in order to provide a start-up flame and effect a preheating state of the combustion system 100 when the distal flame holder 102 needs to be pre-heated and to change (e.g., turn down) the flow rate of the pilot fuel provided by the pilot fuel distributor 106 when the distal flame holder 102 is at an operating temperature (e.g., when $T \geq T_S$). In some embodiments, the pilot fuel distributor is controlled to provide pilot fuel at the same time that a main fuel distributor 110 provides a main fuel to the distal flame holder 102, thus supplementing the combustion capacity of the combustion system 100.

Various approaches for actuating a start-up flame are contemplated. In one embodiment, the pilot fuel distributor includes a mechanically-actuated bluff body configured to be actuated to intercept the fuel and oxidant mixture 206 to cause heat-recycling and/or stabilizing vortices and thereby hold the start-up flame; or to be actuated to not intercept the fuel and oxidant mixture 206 to cause the fuel and oxidant mixture 206 to proceed to the distal flame holder 102. In another embodiment, a fuel control valve, blower, and/or damper may be used to select a pilot fuel and oxidant mixture flow rate that is sufficiently low for a start-up flame to be jet-stabilized; and upon reaching a distal flame holder operating temperature, the mixture flow rate may be decreased to just maintain a pilot flame, or increased to supplement main combustion.

An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder. Other forms of start-up apparatuses are contemplated. For example, a start-up apparatus can include a pilot flame apparatus disposed to ignite the fuel and oxidant mixture 206 that would otherwise enter the distal flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the distal flame holder 102 before the distal flame holder 102 is heated sufficiently to maintain combustion.

The burner system 200 can further include a sensor 234 (corresponding in some embodiments with at least one of the pilot flame sensor 124 and the distal flame holder sensor 122 in FIG. 1) operatively coupled to the control circuit 230. The sensor 234 can include a heat sensor configured to detect infrared radiation or a temperature of the distal flame holder 102. The control circuit 230 can be configured to control a heating apparatus responsive to input from the sensor 234. Optionally, a fuel control valve 236 can be operatively coupled to the controller 230 and configured to control a flow of the fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction 302 held by the distal flame holder 102. The fuel control valve 236 can be configured to control a flow of the fuel from a fuel source to the fuel and oxidant source 202. The controller 230 can be configured to control the fuel control valve 236 responsive to input from the combustion sensor 234. The controller 230 can be configured to control the fuel control valve 236 and/or the oxidant blower or damper 238 to control a preheat flame to heat the distal flame holder 102 to an operating temperature. The controller 230 can similarly control the fuel control valve 236 and/or the oxidant blower or damper 238 to change the fuel and oxidant mixture 206 flow responsive to a heat demand change received as data via the data interface 232.

Figure 5A:
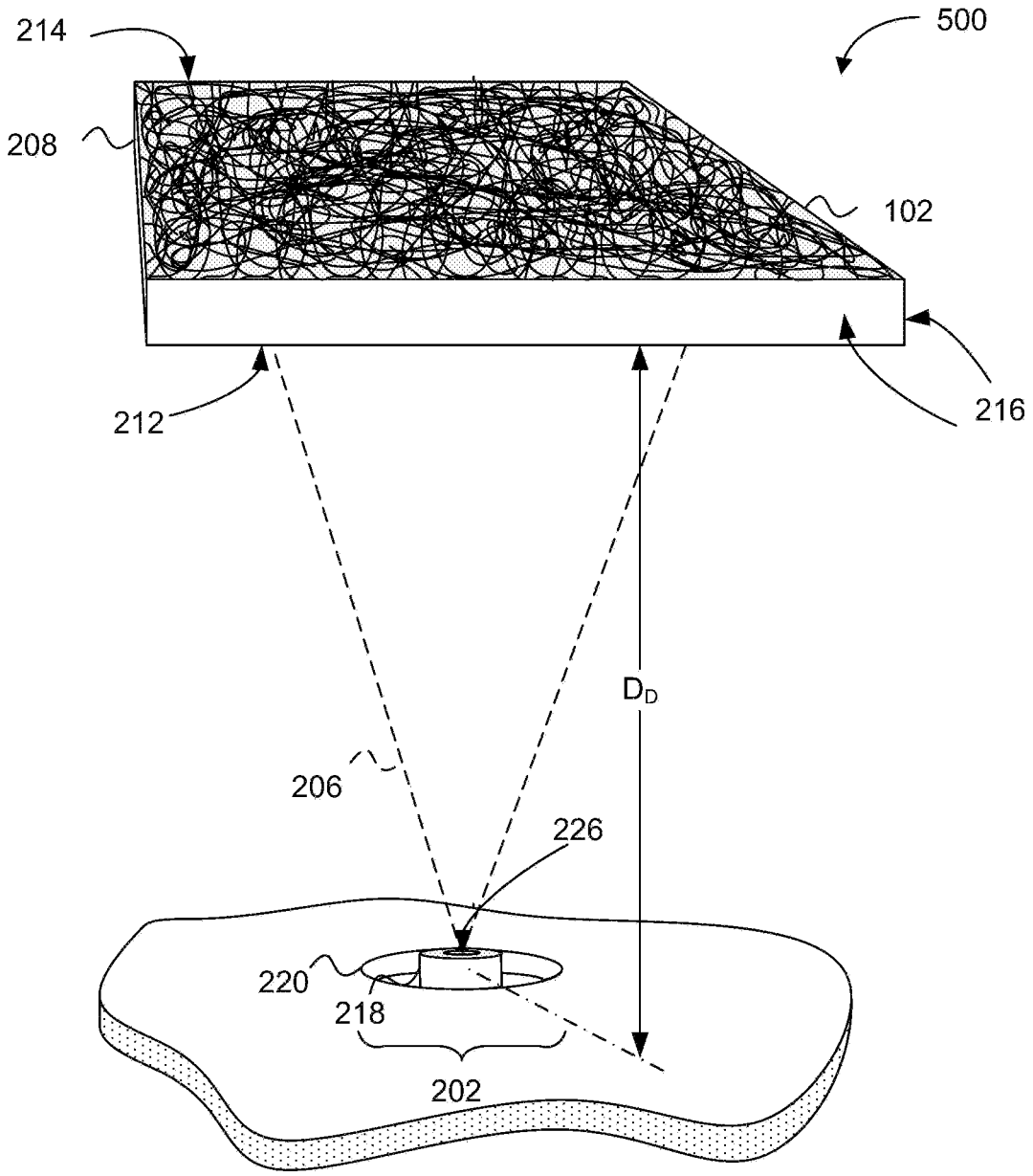
FIG. 5A is a simplified diagram of a combustion system including a reticulated ceramic distal flame holder configured to hold a combustion reaction, according to an embodiment.
Figure 5B:
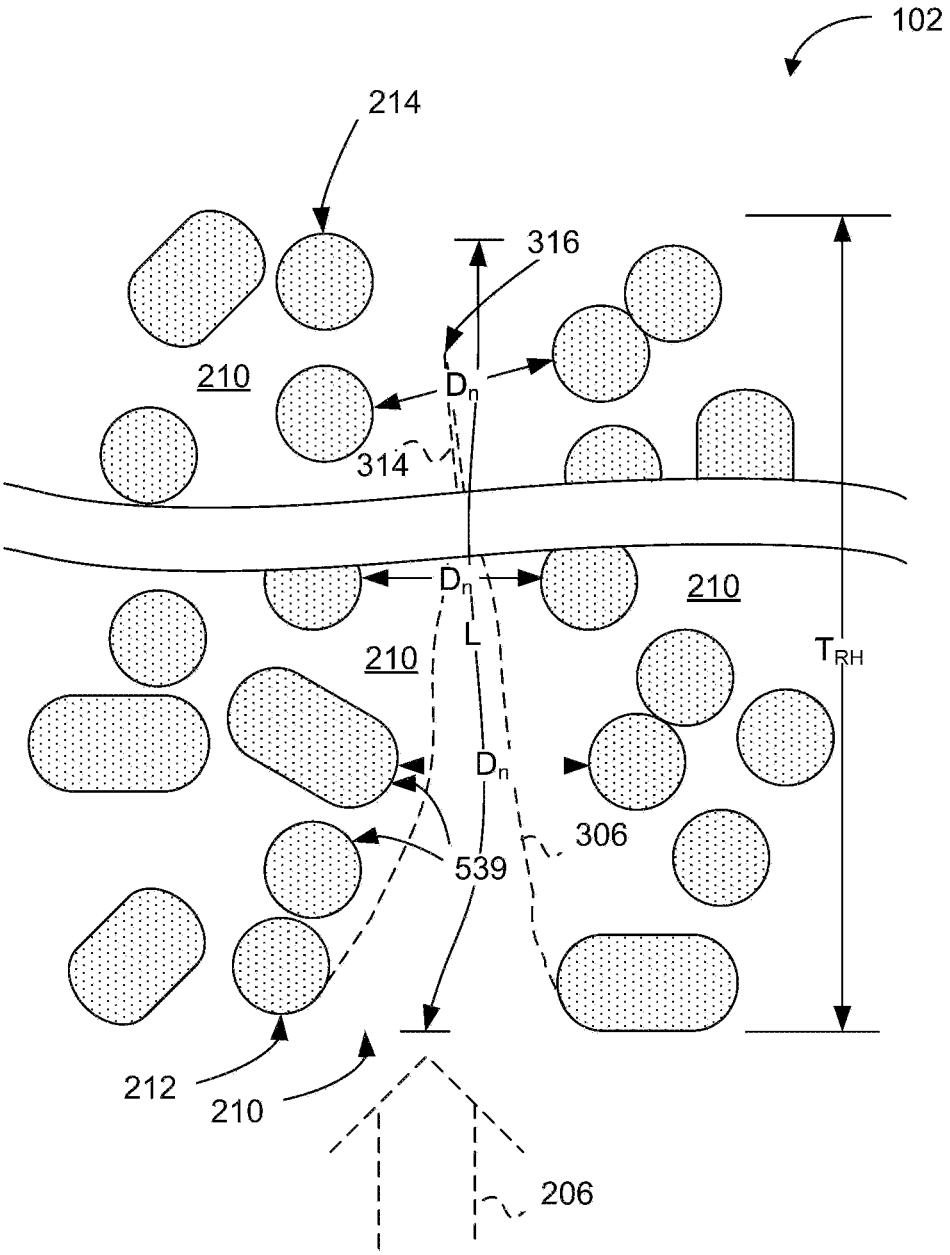
FIG. 5B is a side sectional diagram of a portion of the reticulated ceramic distal flame holder of FIG. 5A, according to an embodiment.

FIG. 5A is a simplified perspective view of a combustion system 500, including another alternative perforated flame holder body 208, according to an embodiment. The perforated flame holder body 208 is a reticulated ceramic perforated flame holder, according to an embodiment. FIG. 5B is a simplified side sectional diagram of a portion of the reticulated ceramic perforated flame holder body 208 of FIG. 5A, according to an embodiment. The distal flame holder 102 of FIGS. 5A, 5B can be implemented in the various combustion systems described herein, according to an embodiment. A distal flame holder 102 incorporating a perforated flame holder body 208 is configured to support a combustion reaction 302 of the fuel and oxidant mixture 206 at least partially within the perforated flame holder body 208. According to an embodiment, the distal flame holder 102 incorporating a perforated flame holder body 208 can be configured to support a combustion reaction 302 of the fuel and oxidant mixture 206 upstream, downstream, within, and adjacent to the reticulated ceramic perforated flame holder body 208.

According to an embodiment, the perforated flame holder body 208 can include reticulated fibers 539. The reticulated fibers 539 can define branching perforations 210 that weave around and through the reticulated fibers 539. According to an embodiment, the perforations 210 are formed as passages through the reticulated ceramic fibers 539.

According to an embodiment, the reticulated fibers 539 are formed as a reticulated ceramic foam. According to an embodiment, the reticulated fibers 539 are formed using a reticulated polymer foam as a template. According to an embodiment, the reticulated fibers 539 can include alumina silicate. According to an embodiment, the reticulated fibers 539 can be formed from extruded mullite or cordierite. According to an embodiment, the reticulated fibers 539 can include Zirconia. According to an embodiment, the reticulated fibers 539 can include silicon carbide.

The term "reticulated fibers" refers to a netlike structure. According to an embodiment, the reticulated fibers 539 are formed from an extruded ceramic material. In reticulated fiber embodiments, the interaction between the fuel and oxidant mixture 206, the combustion reaction 302, and heat transfer to and from the perforated flame holder body 208 can function similarly to the embodiment shown and described above with respect to FIGS. 2-4. One difference in activity is a mixing between perforations 210, because the reticulated fibers 539 form a discontinuous perforated flame holder body 208 that allows flow back and forth between neighboring perforations 210.

According to an embodiment, the reticulated fiber network is sufficiently open for downstream reticulated fibers 539 to emit radiation for receipt by upstream reticulated fibers 539 for the purpose of heating the upstream reticulated fibers 539 sufficiently to maintain combustion of a fuel and oxidant mixture 206. Compared to a continuous perforated flame holder body 208, heat conduction paths 312 between reticulated fibers 539 are reduced due to separation of the reticulated fibers 539. This may cause relatively more heat to be transferred from the heat-receiving region 306 (heat receiving area) to the heat output region 310 (heat output area) of the reticulated fibers 539 via thermal radiation 304.

According to an embodiment, individual perforations 210 may extend from an input face 212 to an output face 214 of the perforated flame holder body 208. Perforations 210 may have varying lengths L. According to an embodiment, because the perforations 210 branch into and out of each other, individual perforations 210 are not clearly defined by a length L.

According to an embodiment, the perforated flame holder body 208 is configured to support or hold a combustion reaction 302 or a flame at least partially between the input face 212 and the output face 214. According to an embodiment, the input face 212 corresponds to a surface of the distal flame holder 102 proximate to the fuel nozzle 218 or to a surface that first receives fuel. According to an embodiment, the input face 212 corresponds to an extent of the reticulated fibers 539 proximate to the fuel nozzle 218. According to an embodiment, the output face 214 corresponds to a surface distal to the fuel nozzle 218 or opposite the input face 212. According to an embodiment, the input face 212 corresponds to an extent of the reticulated fibers 539 distal to the fuel nozzle 218 or opposite to the input face 212.

According to an embodiment, the formation of boundary layers 314, transfer of heat between the perforated flame holder body 208 and the gases flowing through the perforations 210, a characteristic perforation width dimension D, and the length L can be regarded as related to an average or overall path through the perforated flame holder body 208. In other words, the dimension D can be determined as a root-mean-square of individual Dn values determined at each point along a flow path. Similarly, the length L can be a length that includes length contributed by tortuosity of the flow path, which may be somewhat longer than a straight-line distance TRH from the input face 212 to the output face 214 through the perforated flame holder body 208. According to an embodiment, the void fraction (expressed as (total distal flame holder 102 volume−reticulated fiber 539 volume)/total volume)) is about 70%.

According to an embodiment, the reticulated ceramic perforated flame holder body 208 is a tile about 1"×4"×4". According to an embodiment, the reticulated ceramic perforated flame holder body 208 includes about 100 pores per square inch of surface area. Other materials and dimensions can also be used for a reticulated ceramic perforated flame holder body 208 in accordance with principles of the present disclosure.

According to an embodiment, the reticulated ceramic distal flame holder 102 can include shapes and dimensions other than those described herein. For example, the distal flame holder 102 can include reticulated ceramic tiles that are larger or smaller than the dimensions set forth above. Additionally, the reticulated ceramic distal flame holder 102 can include shapes other than generally cuboid shapes.

According to an embodiment, the reticulated ceramic distal flame holder 102 can include multiple reticulated ceramic tiles. The multiple reticulated ceramic tiles can be joined together such that each ceramic tile is in direct contact with one or more adjacent reticulated ceramic tiles. The multiple reticulated ceramic tiles can collectively form a single distal flame holder 102. Alternatively, each reticulated ceramic tile can be considered a distinct distal flame holder 102.

According to an embodiment, referring back to FIG. 1, the pilot fuel distributor 106 includes a fuel nozzle disposed proximate to the main fuel distributor 110. The controller 116 may be configured to cause the flow of the pilot fuel to stop and the flow of the main fuel to start when the distal flame holder 102 is determined to be at a predetermined operating temperature.

According to another embodiment, referring again to FIG. 1, the pilot fuel distributor 106 includes a pilot flame support assembly 103 disposed distal from the main fuel distributor 110, at a distance intermediate between the primary fuel distributor and the distal flame holder 102. The controller 116 may be configured to cause the flow of the pilot fuel to decrease so as to maintain a pilot flame supported by the pilot flame support assembly 103 and the flow of the main fuel to start when the distal flame holder 102 is determined to be at a predetermined operating temperature.

Figure 6:
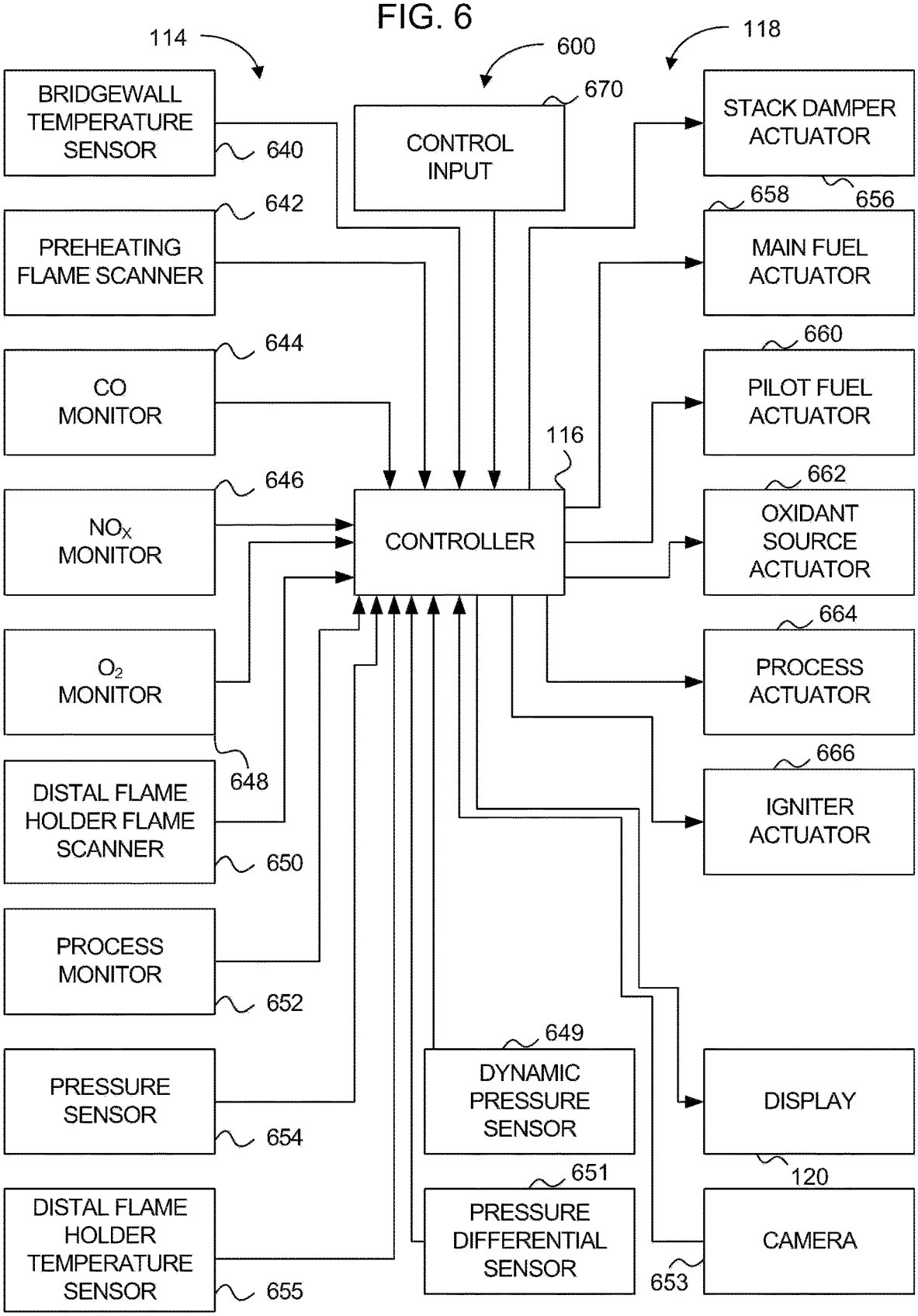
FIG. 6 is a block diagram of components of a combustion system, according to an embodiment.

FIG. 6 is a block diagram of components of a combustion control system 600, according to an embodiment. The combustion control system 600 includes a controller 116, a set of sensors 114, a set of actuators 118, a display 120, and a control input 670. The set of sensors 114, the set of actuators 118, the control input 670, and the display 120 are communicatively coupled to the controller 116 such that the controller 116 can send, or receive signals, instructions, or data from the components. These components are utilized to monitor, control, and adjust operation of the combustion system 600 with respect to holding a combustion reaction 302 in a distal flame holder 102 (see FIGS. 1-3, 5A, and 5B).

In one embodiment, the set of sensors 114 includes a bridgewall temperature sensor 640, a pilot flame scanner 642, a CO monitor 644, a $NO_X$ monitor 646, an $O_2$ monitor 648, a dynamic pressure sensor 649, a distal flame holder flame scanner 650, a pressure differential sensor 651, a process monitor 652, a camera 653, a pressure sensor 654, and a distal flame holder temperature sensor 655. These sensors monitor various parameters of the combustion system 600 and output sensor signals to the controller 116. The sensor signals indicate various parameters of the combustion system 600. The set of sensors 114 can include fewer sensors, more sensors, or different kinds of sensors than those shown in FIG. 6.

In one embodiment, the set of actuators 118 include a stack damper actuator 656, a main fuel actuator 658, a pilot fuel actuator 660, an oxidant source actuator 662, a process actuator 664, and an igniter actuator 666. The set of actuators 118 receive electrical commands and instructions from the controller 116. The set of actuators 118 activate, control, or adjust components of the combustion system 600 responsive to the commands from the controller 116. Additionally, or alternatively, the set of actuators 118 can be operated manually by an operator of the combustion system 600.

In one embodiment, the display 120 displays messages, data, or other indications from the controller 116. The operator or technician of the combustion system 600 can receive information via the display 120. The controller 116 can output messages via the display 120 indicating various parameters of the combustion system 600 as measured by the set of sensors 114. The controller 116 can output messages via the display 120 indicating operations that the controller 116 will undertake, such as transitioning from a preheating state to a standard operating state or controlling one or more of the set of actuators 118 responsive to the sensor signals. The display 120 can also display prompts requesting input from the operator of the combustion system 600 requesting that the operator provide approval or permission to execute one or more proposed actions. Upon receiving input from the operator, the controller 116 can undertake actions or refrain from action in accordance with the instructions received from the operator.

In one embodiment, the control input 670 enables the operator of the combustion system 600 to enter commands to the controller 116. The control input 670 can include one or more of a keypad, a keyboard, a touchscreen, buttons, switches, a mouse, a trackpad, or any other suitable way for the operator of the combustion system 600 to input data or commands to the controller 116. The control input 670 can communicate with the controller 116 via any suitable data transfer interface. In one embodiment, when the controller 116 outputs a message on the display 120 requesting input from the operator to proceed with a proposed adjustment to the combustion system 600, the operator can include a command to the controller 116 via the control input 670 responsive to the message on the display 120. The operator can also utilize the control input 670 to override actions taken by the controller 116 in controlling the combustion system 600.

In one embodiment, the bridgewall temperature sensor 640 senses a temperature of a furnace bridgewall. The temperature of the furnace bridgewall provides an indication of whether a process of the furnace is ready for operation. As the distal flame holder 102 sustains a combustion reaction 302, the temperature of the furnace bridgewall will increase. When the bridgewall of the furnace has reached a selected threshold temperature, the combustion system 600 can initiate a process.

In an embodiment, the controller 116 receives the temperature of the furnace bridgewall from the bridgewall temperature sensor 640 and takes one or more actions based on the temperature of the furnace bridgewall and on one or more algorithms, state machines, or other software instructions implemented by the controller 116. In one example, if the sensor signal from the bridgewall temperature sensor 640 indicates that the temperature of the furnace bridgewall is above the threshold temperature, then the controller 116 can send the sensor signal to the process actuator 664. The process actuator 664 can activate a process, such as initiating the flow of a working fluid to be heated by the furnace. In one embodiment, if the bridgewall temperature sensor 640 indicates that the temperature of the furnace bridgewall is below the threshold temperature, then the controller 116 refrains from activating the process actuator 664. In one embodiment, if the process is already active, and the sensor signal from the bridgewall temperature sensor 640 indicates that the temperature of the furnace bridgewall has fallen below the threshold temperature, then the controller 116 can take measures to increase the heat output by the distal flame holder 102 by operating the main fuel actuator 658 to adjust flow of the main fuel, the oxidant source actuator 662 to adjust the flow of the oxidant, the stack damper actuator 656 to adjust the movement or position of the stack damper, or any other actuators that can adjust a parameter of the combustion system 600 to increase output from the distal flame holder 102. The controller 116 can also cause the process actuator 664 to adjust or stop the process until the temperature of the furnace bridgewall increases beyond a threshold temperature.

In one embodiment, the pilot flame scanner 642 monitors parameters of the pilot flame while the combustion system 600 is in the preheating state. The pilot flame scanner 642 can detect whether the pilot flame is present. The pilot flame scanner 642 can detect the position of the pilot flame. The pilot flame scanner 642 outputs a sensor signal to the controller 116 indicating the presence, the absence, the position, or other parameters of the pilot flame.

In one embodiment, when the controller 116 receives the sensor signal from the pilot flame scanner 642, the controller 116 takes one or more actions based on the parameters of the pilot flame. If the sensor signal from the pilot flame scanner 642 indicates that the pilot flame is not present, then the controller 116 can send command signals to the oxidant source actuator 662 to adjust the flow of the oxidant, to the pilot fuel actuator 660 to adjust the flow of the pilot fuel, and to the igniter actuator 666 to ignite the pilot flame by generating an electric arc or in any other suitable way.

In one embodiment, if the sensor signal from the pilot flame scanner 642 indicates that the position of the pilot flame is too far from the distal flame holder 102 or too close to the distal flame holder 102, then the controller 116 can output control signals that cause the pilot fuel actuator 660 to adjust a flow rate of the pilot fuel, or to adjust a fuel mixture of the pilot fuel. The controller 116 can also issue commands to the oxidant source actuator 662 causing the oxidant source actuator 662 to increase or decrease the flow of the oxidant.

In one embodiment, the CO monitor 644 monitors the concentration of CO and flue gases generated by the combustion reaction 302 of the main fuel and the oxidant in the standard operating state. The CO monitor 644 outputs sensor signals to the controller 116 indicating concentration of CO in the flue gases generated by the combustion reaction 302 held by the distal flame holder 102. The controller 116 receives the sensor signals and takes one or more actions based on the CO concentration as indicated by the sensor signals from the CO monitor 644.

In one embodiment, if the concentration of CO in the flue gas is below an acceptable value, then the controller 116 may not adjust any parameters of the combustion system 600 in order to maintain the current state of the combustion reaction 302. If the concentration of CO in the flue gas is higher than an acceptable value, then the controller 116 can send signals to the main fuel actuator 658, the oxidant source actuator 662, or the stack damper actuator 656 in order to adjust the combustion reaction 302 of the main fuel and the oxidant. The controller 116 can cause the main fuel actuator 658 to adjust the flow of the main fuel or the mixture of fuels that make up the main fuel in order to cause the combustion reaction 302 of the main fuel and the oxidant to generate less CO. The controller 116 can also cause the oxidant source actuator 662 to adjust the flow of the oxidant into the furnace in order to reduce the concentration of CO in the flue gas.

In one embodiment, the $NO_X$ monitor 646 senses the concentration of $NO_X$ in the flue gas generated by the combustion reaction 302 of the main fuel and the oxidant held by the distal flame holder 102 in the standard operating state. The $NO_X$ monitor 646 outputs a sensor signal to the controller 116 indicating the concentration of $NO_X$ in the flue gas. The controller 116 can take one or more actions based on the concentration of the $NO_X$ in the flue gas as indicated by the sensor signal.

In one embodiment, if the sensor signal from the $NO_X$ monitor 646 indicates that the $NO_X$ concentration is higher than a threshold value, for example higher than 10 ppm, then the controller 116 can take actions to reduce the concentration of $NO_X$ in the flue gas. In one embodiment, the controller 116 can control the oxidant source actuator 662 to increase the flow of the oxidant from the oxidant source. Additionally, or alternatively, the controller 116 controls the main fuel actuator 658 to decrease the flow of the main fuel or to otherwise adjust parameters of the flow of the main fuel in order to decrease the concentration of $NO_X$ in the flue gas.

In one embodiment, the $O_2$ monitor 648 monitors the presence of $O_2$ in the flue gas. The $O_2$ monitor 648 outputs a sensor signal to the controller 116 indicating the concentration of $O_2$ in the flue gas. The controller 116 receives the sensor signal from the $O_2$ monitor 648 and undertakes one or more actions based on the concentration of $O_2$ in the flue gas.

In one embodiment, it is desirable that the concentration of $O_2$ in the flue gas fall within a selected range, e.g., greater than or equal to 2% and less than or equal to 5%. If the sensor signal from the $O_2$ monitor 648 indicates that the concentration of $O_2$ is below the selected range, then the controller 116 can control the oxidant source actuator 662 to increase the flow of the oxidant into the furnace. Additionally, or alternatively, the controller 116 can increase the concentration of $O_2$ in the flue gas by decreasing the flow of the main fuel into the furnace. If the sensor signal from the $O_2$ monitor 648 indicates that the concentration of $O_2$ is greater than the selected range, then the controller 116 can cause the oxidant source actuator 662 to decrease the flow of the oxidant into the furnace. Additionally, or alternatively, the controller 116 can cause the main fuel actuator 658 to increase the flow of the main fuel into the furnace in order to decrease the concentration of $O_2$ in the flue gas. In some cases, a higher than desired concentration of $O_2$ can be the result of incomplete fuel burn. Thus, the controller 116 can control the main fuel actuator 658 to reduce the velocity (or flow rate) of the main fuel in order to more completely combust the main fuel.

In one embodiment, the dynamic pressure sensor 649 detects changes in pressure with time at one or more locations in the combustion environment. The dynamic pressure sensor 649 generates sensor signals indicative of the change in pressure in the furnace over time or of the draft of the oxidant. The sensor signals from the dynamic pressure sensor 649 can indicate a slope or derivative of the pressure with respect to time and/or may be converted to frequency domain to detect audible or inaudible noise caused by pressure waves. The inventors note that the dynamic pressure sensor 649 produces a signal indicative of stability of a combustion reaction in the distal flame holder 102. When the combustion reaction is stable, there is relatively constant pressure at the dynamic pressure sensor 649. When the combustion reaction is unstable, the dynamic pressure sensor 649 produces a signal corresponding to rapid fluctuations in pressure, a condition that has been noted by the inventors to correspond to relatively high audible noise produced by the flowing gas in the furnace. The controller 116 can undertake one or more actions to adjust the pressure or other combustion parameters responsive to the sensor signal from the dynamic pressure sensor 649.

In one embodiment, the controller 116 can increase or decrease the pressure by controlling the oxidant source actuator 662 to adjust the flow of the oxidant responsive to the sensor signals provided by the dynamic pressure sensor 649. The controller 116 can adjust the pressure by causing the stack damper actuator 656 to adjust the stack damper. The controller 116 can adjust the pressure by causing the main fuel actuator 658 to adjust the flow of the main fuel. The controller 116 can also undertake other actions to adjust the pressure responsive to sensor signals provided by the dynamic pressure sensor 649.

In one embodiment, the pressure differential sensor 651 detects pressure differentials or differences across two or more locations in the furnace, such as across the distal flame holder 102. The controller 116 can undertake one or more actions to adjust the pressure or other combustion parameters responsive to the sensor signal from the pressure differential sensor 651.

In one embodiment, the controller 116 can increase or decrease the pressure by controlling the oxidant source actuator 662 to adjust the flow of the oxidant. The controller 116 can adjust the pressure by causing the stack damper actuator 656 to adjust the stack damper. The controller 116 can adjust the pressure by causing the main fuel actuator 658 to adjust the flow of the main fuel. The controller 116 can also undertake other actions to adjust the pressure responsive to sensor signals provided by the dynamic pressure sensor 649.

In one embodiment, the distal flame holder flame scanner 650 monitors parameters of the combustion reaction 302 of the main fuel and the oxidant held by the distal flame holder 102. The distal flame holder flame scanner 650 outputs a sensor signal to the controller 116 indicating the parameters of the combustion reaction 302 held by the distal flame holder 102 in the standard operating state.

In one embodiment, the distal flame holder flame scanner 650 can detect whether the combustion reaction 302 of the main fuel and the oxidant is present at the distal flame holder 102. If the sensor signals output by the distal flame holder flame scanner 650 indicate that the combustion reaction 302 of the main fuel and the oxidant is not present, then the controller 116 can undertake one or more actions. For example, the controller 116 can cause a flow of the pilot fuel to the pilot flame to increase to provide additional heat to the distal flame holder 102 so that the distal flame holder 102 is at a sufficient temperature to initiate a combustion reaction 302 of the main fuel and the oxidant. The controller 116 can thus cause the combustion system 600 to revert back to the preheating state by controlling the main fuel actuator 658, the pilot fuel actuator 660, the oxidant source actuator 662, and the igniter actuator 666 to cease the flow of the main fuel, to adjust the flow of the oxidant, to initiate a flow of the pilot fuel, and to ignite the pilot flame until the distal flame holder 102 has reached the threshold temperature.

In one embodiment, if the sensor signals output by the distal flame holder flame scanner 650 indicate that the combustion reaction 302 of the main fuel and the oxidant is concentrated too far upstream from the distal flame holder 102 or too far downstream from the distal flame holder 102, then the controller 116 can control the main fuel actuator 658 to adjust the flow rate, the velocity, the mixture, or other parameters of the main fuel. The controller 116 can also cause the oxidant source actuator 662 to adjust the flow of the oxidant in order to cause the combustion reaction 302 of the main fuel and the oxidant to be held by the distal flame holder 102.

In one embodiment, the distal flame holder flame scanner 650 can indicate how much heat is generated by the combustion of the main fuel and the oxidant. If the sensor signals from the distal flame holder flame scanner 650 indicate that the combustion reaction 302 of the main fuel and the oxidant is generating too much heat or too little heat, then the controller 116 can take one or more actions. For example, the controller 116 can adjust the flow or mixture of the main fuel by controlling the main fuel actuator 658. The controller 116 can also cause the oxidant source actuator 662 to adjust the flow of the oxidant to increase or decrease the temperature of the combustion reaction 302 of the main fuel and the oxidant.

In one embodiment, the process monitor 652 measures parameters of the process, such as the transfer of heat from the combustion reaction 302 of the main fuel and the oxidant to a working fluid. The process monitor 652 outputs sensor signals to the controller 116 indicating the parameters of the process. The controller 116 can take one or more actions to adjust the parameters of the process responsive to the sensor signals.

In one embodiment, the controller 116 can control the process actuator 664 in order to adjust one or more aspects of the process responsive to the sensor signal from the process monitor 652. Additionally, or alternatively, the controller 116 can control one or more other actuators to adjust parameters of the combustion reaction 302 of the main fuel and the oxidant in order to adjust the parameters of the process.

In one embodiment, a camera 653 monitors one or more conditions within the furnace and outputs sensor signals indicative of the monitored condition. The camera 653 can include a charge coupled device (CCD) camera, a CMOS camera, or other types of cameras. The camera 653 can be part of one or more other sensors in the sensor array 114. The camera 653 can monitor visual parameters of the distal flame holder 102, the combustion reaction 302 within the distal flame holder 102, the pilot flame, flashback of the combustion reaction 302, the physical condition of components, actuators, sensors, or other conditions within the furnace. The controller 116 can take one or more actions in response to the sensor signals from the camera 653. The camera 653 can detect UV wavelengths, IR wavelengths, and/or visible light wavelengths. The camera 653 can include a video camera or other kinds of cameras.

In one embodiment, the camera 653 can convert the field of view with a phase mask and detect a signal with a planar CCD or a CMOS array, not as an image of the field of view, but as matrix data that can be decoded to focus at a range of focal planes.

In one embodiment, the sensor array 114 can include a flashback sensor configured to detect flashback of the combustion reaction 302 from the distal flame holder 102 towards the main fuel distributor(s) 110. The flashback sensor can be part of one or more other sensors in the sensor array 114. The flashback sensor can include one or more of a camera, an infrared sensor, a flame rod, a UV sensor, a CCD camera, thermocouples, photo cells, electrodes, or other kinds of devices capable of sensing flashback.

In one embodiment, the controller 116 can control the turndown ratio in the furnace response to sensor signals from one or more of the sensors in the sensor array 114 or from sensors not shown or described herein. The controller 116 can control or adjust the turndown ratio by operating one or more actuators 118 to adjust parameters of the combustion environment such as fuel flow parameters, oxidant parameters, operating state parameters, or other parameters.

In one embodiment, the combustion system 600 can include multiple distal flame holders 102. The combustion system 600 can include multiple main fuel distributors 110, multiple oxidant sources 104, multiple pilot fuel distributors 106, and multiple other components to operate the multiple distal flame holders 102. The combustion system 600 can include multiple of the various sensors 114 to sense the parameters related to the multiple distal flame holders 102. The controller 116 can adjust the parameters related to the multiple distal flame holders 102 in response to the sensor signals from the various sensors 114. The sensors can control the operations related to the multiple distal flame holders 102 based on huffing, instability, and turndown as indicated by the sensors of the sensor array 114. The controller 116 can also cease operation of one or more of the distal flame holders 102 or can select which and how many of the multiple distal flame holders 102 should be in operation. The controller 116 can control the set of actuators 118 to control, operate, select, or stop operations related to the multiple distal flame holders 102.

The combustion system 600 can also be a multi-fuel system that utilizes multiple fuels or kinds of fuel in holding a combustion reaction 302 in one or more distal flame holders 102. The controller 116 can control the flow of the multiple fuels, select which fuels to use, or select mixtures or blends of fuel based on the sensor signals from the various sensors of the sensor array 114.

In one embodiment, the pressure sensor 654 monitors pressure in the furnace or the draft pressure of the oxidant. The pressure sensor 654 sensor signals and outputs into the controller 116 a signal indicative of the pressure in the furnace or of the draft of the oxidant. The controller 116 can undertake one or more actions to adjust the pressure responsive to the sensor signal from the pressure sensor 654.

In one embodiment, the controller 116 can increase or decrease the pressure by controlling the oxidant source actuator 662 to adjust the flow of oxidant. The controller 116 can adjust the pressure by causing the stack damper actuator 656 to adjust the stack damper. The controller 116 can adjust the pressure by causing the main fuel actuator 658 to adjust the flow of the main fuel. The controller 116 can also undertake other actions to adjust the pressure responsive to sensor signals provided by the pressure sensor 654.

In one embodiment, the distal flame holder temperature sensor 655 monitors the temperature of the distal flame holder 102. The distal flame holder temperature sensor 655 generates sensor signals indicating the temperature of the distal flame holder 102 and transmits them to the controller 116. The controller 116 can undertake one or more actions to adjust the temperature of the distal flame holder 102 based on the sensor signals from the distal flame holder temperature sensor 655.

In one embodiment, the distal flame holder temperature sensor 655 monitors the temperature of the distal flame holder 102 during the preheating state of the combustion system 600. Thus, as the pilot flame of the pilot fuel and the oxidant heats the distal flame holder 102, the distal flame holder temperature sensor 655 monitors the temperature of the distal flame holder 102. If the sensor signal indicates that the temperature of the distal flame holder 102 is below the threshold temperature or an operating temperature, then the controller 116 causes the combustion system 600 to remain in the preheating state in which the pilot flame remains present and continues to heat the distal flame holder 102. If the sensor signal from the distal flame holder temperature sensor 655 indicates that the temperature of the distal flame holder 102 has reached the threshold temperature or the operating temperature, then the controller 116 can control the pilot fuel actuator 660 and the main fuel actuator 658 to transition from the preheating state to the standard operating state by ceasing the flow of the pilot fuel and initiating the flow of the main fuel.

In one embodiment, the distal flame holder temperature sensor 655 continues to monitor the temperature of the distal flame holder 102 during the standard operating state. If the sensor signal from the distal flame holder temperature sensor 655 indicates that the temperature of the distal flame holder 102 has dropped below the threshold temperature or the operating temperature, then the controller 116 can take one or more actions. For example, the controller 116 can cause the pilot flame to begin heating the distal flame holder 102. For example, the controller 116 can cause the combustion system 600 to revert to the preheating state by stopping the flow of the main fuel and increasing the flow of the pilot fuel.

In one embodiment, the controller 116 automatically controls the various actuators 118 responsive to the sensor signals from the set of sensors 114 in accordance with one or more sets of software instructions, algorithms, state machines, or other protocols that indicate what actions the controller 116 will take based on the values of the sensor signals generated by the set of sensors 114. In one embodiment, the controller 116 does not automatically control one or more of the actuators 118 responsive to the sensor signals. Instead, the controller 116 outputs prompts or instructions via the display 120 to an operator indicating that the operator should manually adjust components of the combustion system 600 based on the sensor signals. The controller 116 can also prompt the operator to approve actions to be undertaken by the controller 116 so that the controller 116 can control the various actuators 118. The controller 116 can use a mixture of automatic controlling actuators 118, prompting an operator to control the actuators 118, and prompting an operator to approve proposed actions of the controller 116.

Figure 7:
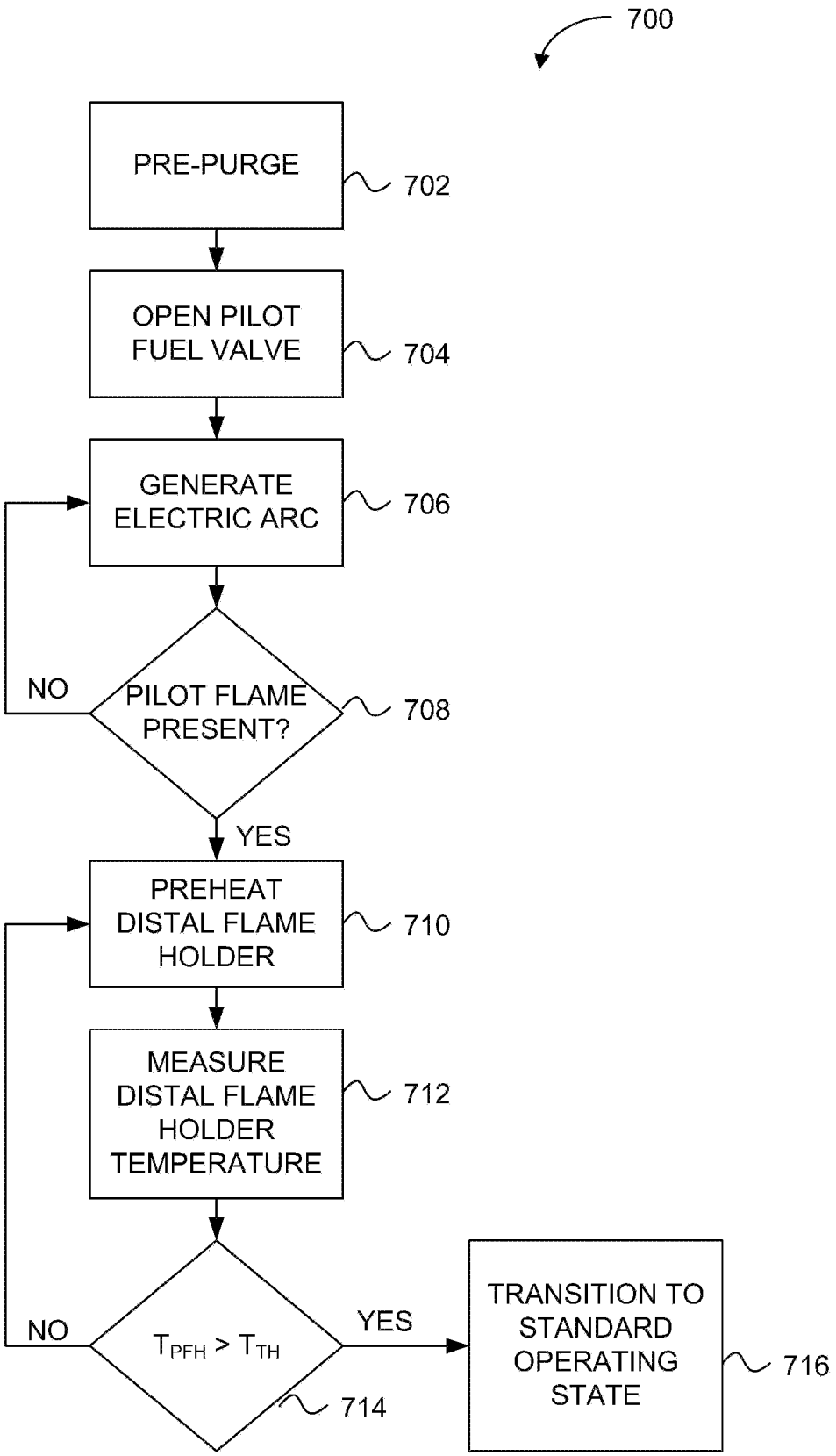
FIG. 7 is a flow diagram of a process for operating a combustion system, according to an embodiment.

FIG. 7 is a flow diagram of a process 700 for operating a combustion system in a preheating state, according to an embodiment. The process 700 can be controlled by a controller 116 executing process steps in accordance with one or more algorithms, sets of software instructions, or state machines. The controller 116 can implement the process 700 by utilizing one or more processors to execute instructions stored on a non-transitory computer readable medium.

At step 702, the process 700 begins by pre-purging a furnace of the combustion system. The pre-purging process includes purging gases, particulates, or debris from the furnace. The pre-purging process can include controlling an oxidant source to flow an oxidant through the furnace in order to clear unwanted gases, particulates, and debris from the furnace. Additionally, or alternatively, the pre-purging process can include passing an inert gas into the furnace in order to remove unwanted gases, particulates, and debris from the furnace. Once the furnace has been purged, the process 700 can proceed to step 704.

In one embodiment, at step 704, the process 700 opens a pilot fuel valve in order to initiate a flow of pilot fuel into the furnace. If the process 700 has not yet begun flowing oxidant into the furnace, then the process 700 can control an oxidant source to begin flowing oxidant into the furnace. From step 704, the process 700 proceeds to step 706.

At step 706, the process 700 ignites the pilot fuel and the oxidant to produce a pilot flame. In one embodiment, the process 700 may ignite the pilot fuel and the oxidant by generating an electric arc. In another embodiment, the process 700 may ignite the pilot fuel and the oxidant by generating a gliding arc. In another embodiment, the process 700 may ignite the pilot fuel and the oxidant by dissipating current through a hot surface igniter. In particular, the controller 116 can control the igniter in order to ignite the pilot flame. From step 706, the process 700 proceeds to decision step 708.

In one embodiment, at decision step 708, the process 700 determines whether or not the pilot flame is present. If the pilot flame is not present, then the process 700 can revert to step 706 and can attempt again to initiate the pilot flame. If the pilot flame is present at decision step 708, then the process 700 can proceed from decision step 708 to step 710.

In one embodiment, at step 710, the process 700 preheats the distal flame holder positioned in the furnace. In particular, the distal flame holder is positioned to receive heat from the pilot flame. The pilot flame heats the distal flame holder, causing the temperature of the distal flame holder to increase. From step 710, the process 700 proceeds to step 712.

In one embodiment, at step 712 the process 700 measures the temperature of the distal flame holder. From step 712, the process 700 proceeds to decision step 714.

In one embodiment, at decision step 714, if the temperature of the distal flame holder $T_{PFH}$ is less than a threshold or operating temperature $T_{TH}$, then the process 700 returns to step 710 and continues to preheat the distal flame holder. At decision step 714, if the temperature of the distal flame holder is greater than the threshold or operating temperature, then the process 700 proceeds to step 716. Typically, the threshold or operating temperature $T_{TH}$ is at or above the auto-ignition temperature of the pilot fuel at the conditions of the system (temperature, humidity, atmospheric pressure). The inventors have noted a very slight transient reduction in distal flame holder temperature $T_{PFH}$ when cold fuel is first introduced to the distal flame holder. The inventors have found it advantageous, therefore, to set the threshold or operating temperature $T_{TH}$ slightly above the pilot fuel auto-ignition temperature.

In one embodiment, at step 716, the process 700 transitions from the preheating state to the standard operating state. In the standard operating state, the pilot flame may be reduced and a combustion reaction of the main fuel and the oxidant is held by the distal flame holder. In one embodiment, the pilot flame used for preheating may be maintained or increased to supplement the combustion reaction of the main fuel and the oxidant at the distal flame holder.

Figure 8:
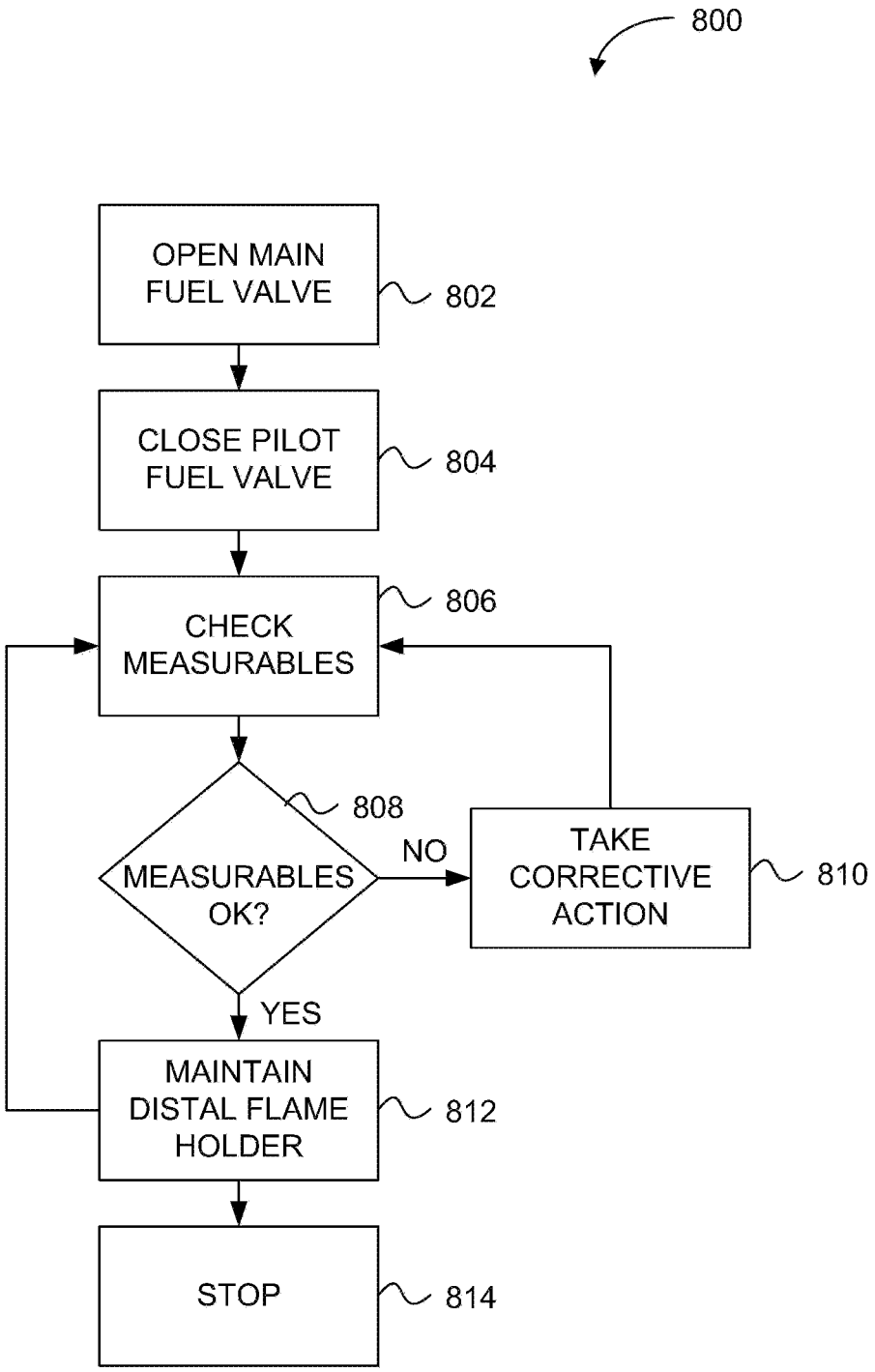
FIG. 8 is a flow diagram of a process for operating a combustion system, according to an embodiment.

FIG. 8 is a flow diagram of a process 800 for operating a combustion system in a standard operating state, according to an embodiment. The process 800 can be controlled by a controller 116 executing process steps in accordance with one or more algorithms, sets of software instructions, or state machines. The controller 116 can implement the process 800 by utilizing one or more processors to execute instructions stored on a non-transitory computer readable medium.

In one embodiment, at step 802, the process 800 transitions from a preheating state to the standard operating state by opening a main fuel valve. With the main fuel valve open, main fuel is output into a furnace. If an oxidant source is not already supplying oxidant to the furnace, then at step 802 the process 800 can also cause the oxidant source to supply the oxidant into the furnace. The main fuel and the oxidant travel towards the distal flame holder and mix together as they travel toward a distal flame holder. In some embodiments, the distal flame holder includes a perforated flame holder that receives the mixture of the main fuel and the oxidant into perforations or channels of the perforated flame holder. Because the distal flame holder has been heated to the operating temperature or threshold temperature, the distal flame holder ignites a combustion reaction of the main fuel and the oxidant. The distal flame holder holds at least a portion of the combustion reaction adjacent to the distal flame holder. Portions of the distal flame holder can also occur downstream and/or upstream from the distal flame holder. From step 802, the process 800 proceeds to step 804.

In one embodiment, at step 804, the process 800 reduces a flow of pilot fuel via a pilot fuel valve, thereby reducing a pilot flame. In some embodiments, the pilot fuel valve can be used to reduce the flow of the pilot fuel prior to opening the main fuel valve. From step 804, the process 800 proceeds to step 806. In one embodiment, at step 806, the process 800 checks measurables or parameters of the combustion system. These measurables can include whether the combustion reaction of the main fuel and the oxidant is present, the location of the combustion reaction of the main fuel and the oxidant, a concentration of various gases in a flue gas, pressure in the furnace, a temperature of a bridgewall of the furnace, parameters of a process receiving heat from the combustion reaction, or other parameters of the combustion system. From step 806, the process 800 proceeds to decision step 808. At decision step 808, the process 800 determines whether the measured conditions of the combustion system are acceptable. If the measured conditions of the combustion system are not acceptable, the process 800 proceeds to step 810. If the measured conditions of the combustion system are acceptable, the process 800 proceeds to step 812.

In one embodiment, at step 810, the process 800 takes corrective action to adjust the parameters of the combustion system. The corrective actions can include adjusting the flow of the main fuel, adjusting the flow of the oxidant, adjusting a stack damper, adjusting a mixture of the main fuel and an oxidant, shutting down the combustion system, reversing to the preheating state, or other kinds of corrective actions. From step 810, the process 800 proceeds to step 806.

In one embodiment, at step 812 the process 800 maintains the present conditions of the distal flame holder and of the combustion system in general. From step 812, the process 800 can proceed back to step 806 for the measurables to be checked again. Alternatively, if the combustion system has accomplished the desired work, the process 800 can proceed to step 814.

In one embodiment, at step 814 the process 800 shuts down the combustion system.

Figure 9:
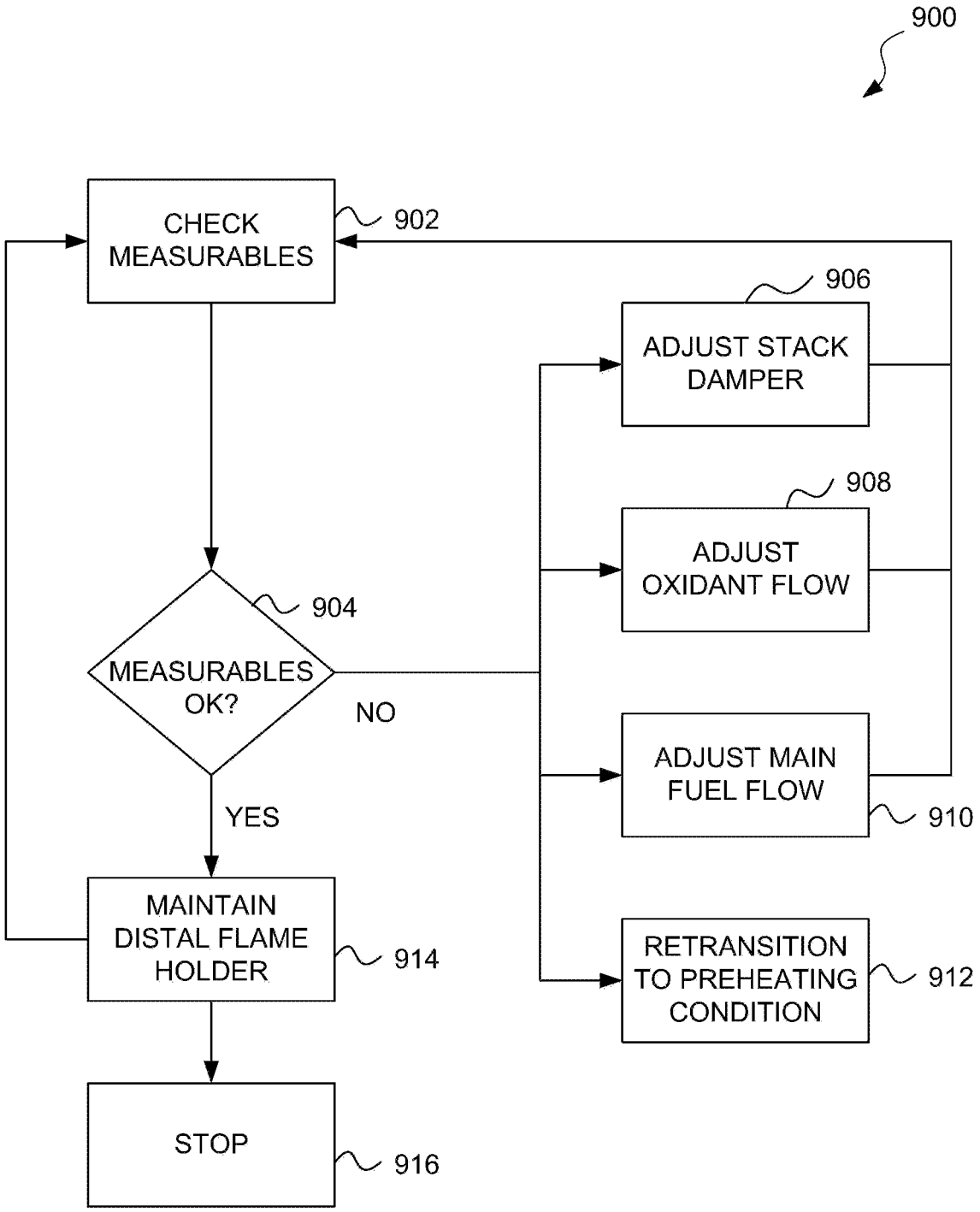
FIG. 9 is a flow diagram of a process for operating a combustion system, according to an embodiment.

FIG. 9 is a flow diagram of a process 900 for operating a combustion system in a standard operating state, according to an embodiment. The process 900 can be controlled by a controller 116 executing process steps in accordance with one or more algorithms, sets of software instructions, or state machines. The controller 116 can implement the process 900 by utilizing one or more processors to execute instructions stored on a non-transitory computer readable medium.

In one embodiment, at step 902, the process 900 checks measurables of the combustion system. These measurables can include whether a combustion reaction of main fuel and oxidant is present, the location of the combustion reaction of the main fuel and the oxidant, a concentration of various gases in a flue gas, pressure in the furnace, a temperature of a bridgewall of a furnace, parameters of the process 900 receiving heat from the combustion reaction, or other parameters of the combustion system. From step 902, the process 900 proceeds to decision step 904. At decision step 904, the process 900 determines whether the measured conditions of the combustion system are acceptable. If the measured conditions of the combustion system are not acceptable, the process 900 proceeds to one or more of steps 906, 908, 910, or 912. If the measured conditions of the combustion system are acceptable, the process 900 proceeds to step 914.

In one embodiment, at step 906 the process 900 adjusts position of a stack damper responsive to the measured parameters of the combustion system. In one embodiment, at step 908 the process 900 adjusts an oxidant flow responsive to the measured parameters of the combustion system. In one embodiment, at step 910 the process 900 adjusts a main fuel flow responsive to the measured parameters of the combustion system. At step 912, the process 900 re-transitions to a preheating state, responsive to the measured parameters of the combustion system.

In one embodiment, at step 914 the process 900 maintains the present conditions of the distal flame holder and of the combustion system in general. From step 912, the process 900 can proceed back to step 902 for the measurables to be checked again. Alternatively, if the combustion system has accomplished the desired work, the process 900 can proceed to step 916.

In one embodiment, at step 916 the process 900 shuts down the combustion system.

Structures for and methods of using a continuous pilot are described in U.S. Provisional Patent Application No. 62,844,669, entitled "PILOT STABILIZED BURNER," filed May 7, 2019, incorporated by reference herein. As used herein, the terms continuous pilot and distal pilot may be used interchangeably and considered synonymous depending on the context, unless further definition is provided.

In an embodiment, a variable-output pilot burner may be positioned at least 0.62 of the distance from main fuel nozzles to a distal flame holder (the larger portion of the distance being between the main fuel nozzles and variable-output pilot burner). The variable output pilot burner may be driven to output a load corresponding to preheating of the distal flame holder or, alternatively, to output a continuous pilot. The inventors have found that by maintaining a continuous pilot flame adjacent to and below (upstream or subjacent) the distal flame holder, a transition step wherein a flame location is shifted between two discrete, different positions may be eliminated. In addition to, or advantageously instead of, the transition step, the continuous pilot is configured to hold a pilot flame according to a plurality of output loads. In an example system, the output loads principally used were two—either stable pilot flame or high output preheat flame where the temperature of the distal flame holder is raised to a main fuel operating temperature over a specified duration. The inventors contemplate that pluralities greater than two output levels may be used to maintain, for example, a very low, flame stability limited operation, a throttled system heat output mode (which in an embodiment may result in elimination of a second cold climate "HVAC" subsystem), a routine and minimum fuel pressure drop pre-heat mode, a demand pre-heat mode, and/or an emergent demand pre-heat mode. System damage recovery modes may one day prove advantageous. The inventors contemplate that a relatively high turndown ratio of the continuous pilot may be obtained by disposing a perforated or porous tile (pilot tile) superjacent to (i.e., downstream from) a plurality of 1 atm fuel nozzles, a low output pilot flame may be stabilized to minimize variable pilot stable heat output. In an embodiment, the system, at moderate to high output, supports low output stable pilot operation to cause greater than 98% of $CO_2$ generation is provided by main fuel nozzle during a normal operating mode. This mode may help reduce $NO_X$ production during normal operation compared to a higher ratio of pilot burner output to main fuel output.

The distal flame holder may include plural porous and/or solid bodies (tiles) with spaces therebetween.

Figure 10A:
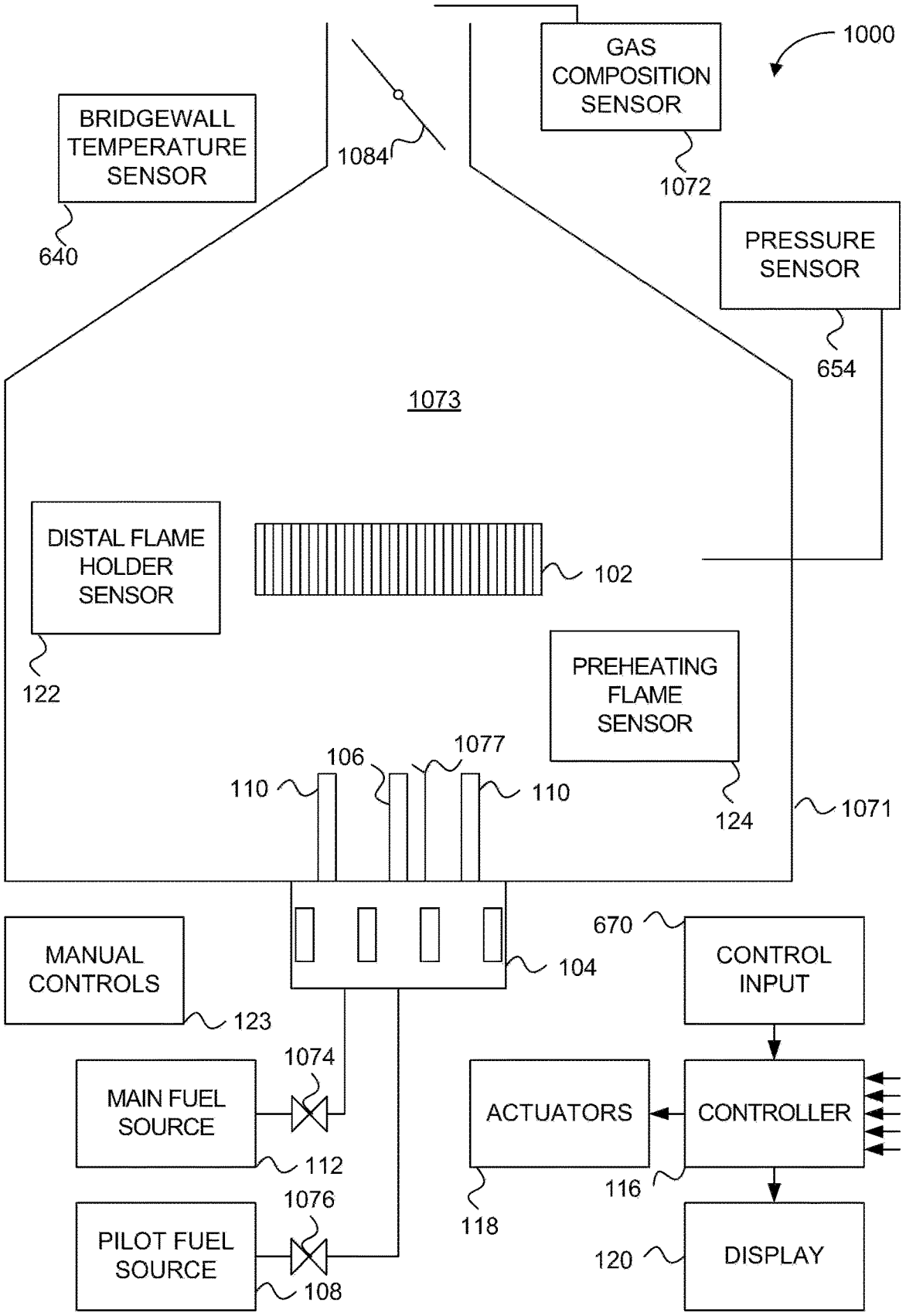
FIG. 10A is a diagram of a combustion system, according to an embodiment.
Figure 10B:
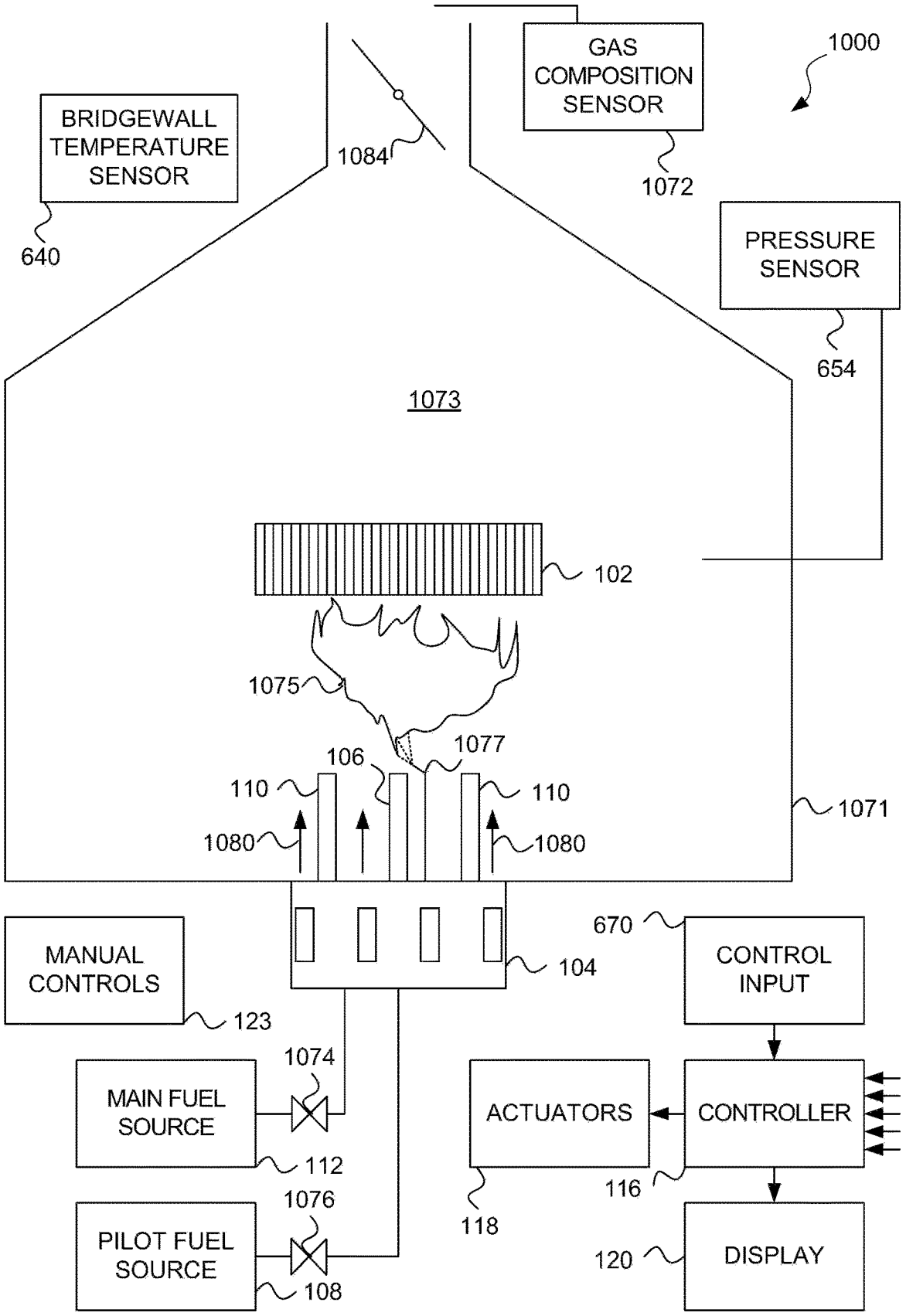
FIG. 10B is a diagram of the combustion system of FIG. 10A in a preheating state, according to an embodiment.
Figure 10C:
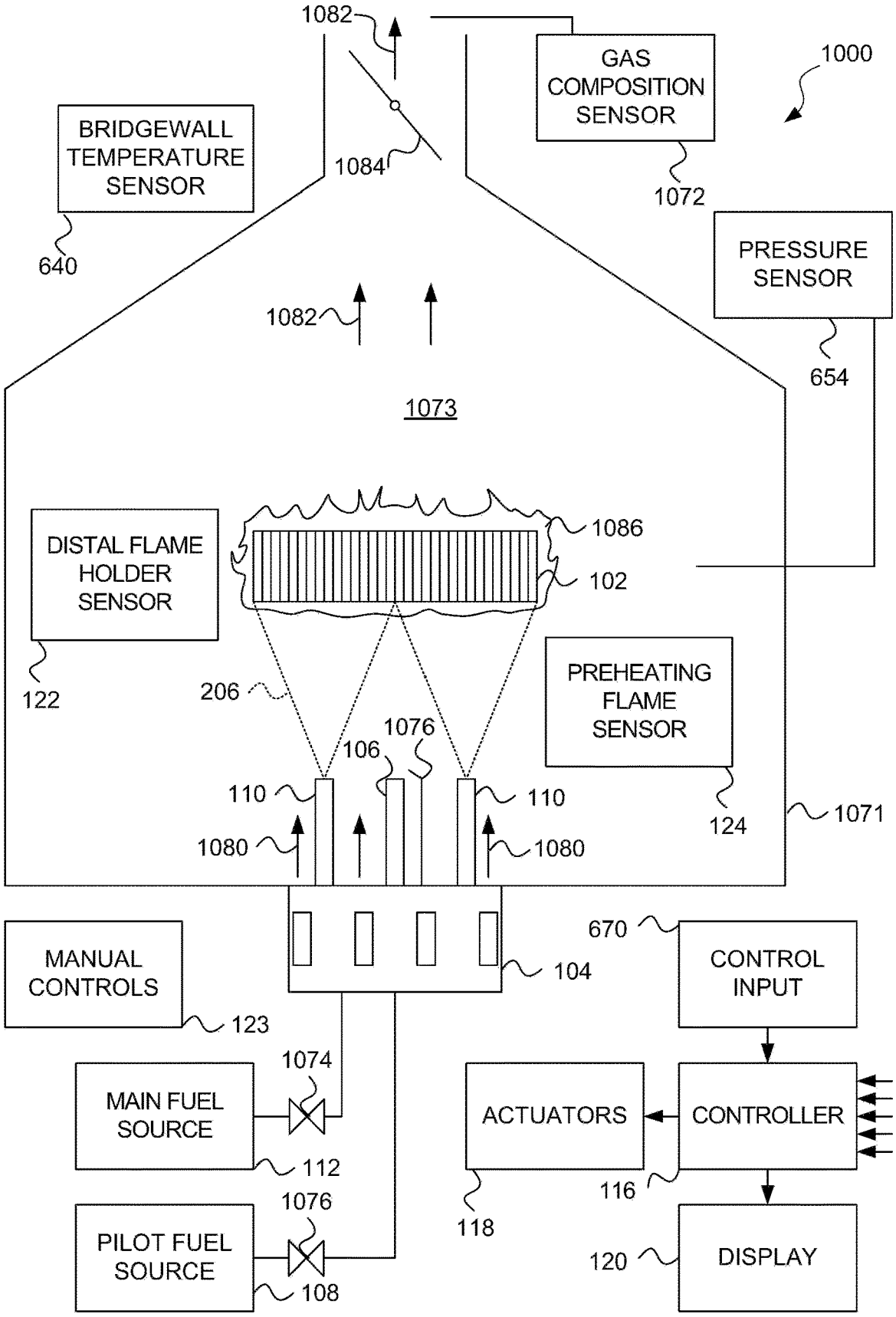
FIG. 10C is a diagram of the combustion system of FIG. 10A in a standard operating state, according to an embodiment.

FIGS. 10A-10C are diagrams of a combustion system 1000 in different states. Descriptions of elements described above having the same reference numbers as in the description below may be incorporated wholly or in various combinations by reference thereto. FIG. 10A is a diagram of the combustion system 1000 in a non-operating state, according to an embodiment. The combustion system 1000 includes a furnace 1071 defining a furnace volume 1073. The combustion system 1000 includes a distal flame holder 102 positioned within the furnace volume 1073. The combustion system 1000 includes one or more main fuel distributors 110, a pilot fuel distributor 106, an igniter 1077, a pilot flame sensor 124, and a distal flame holder sensor 122 positioned within the furnace volume 1073. The combustion system 1000 includes an oxidant source 104, a controller 116, actuators 118, a display 120, a control input 670, manual controls 123, a main fuel source 112, and a pilot fuel source 108. The combustion system 1000 includes one or more main fuel valves 1074 controlling a flow of main fuel from the main fuel source 112 to the main fuel distributors 110. The combustion system 1000 includes one or more pilot fuel valves 1076 controlling a flow of pilot fuel from the pilot fuel source 108 to the pilot fuel distributor 106. The combustion system 1000 includes a stack damper 1084 positioned in a flue of the furnace 1071. The combustion system 1000 further includes a bridgewall temperature sensor 640 and a gas composition sensor 1072.

In one embodiment, the controller 116 may receive sensor signals from the pilot flame sensor 124, the distal flame holder sensor 122, the bridgewall temperature sensor 640, the gas composition sensor 1072, and/or the pressure sensor 654. The controller 116 is coupled to the actuators 118. The various actuators 118 are capable of physically adjusting the main fuel valves 1074, the pilot fuel valves 1076, the oxidant source 104, the main fuel distributors 110, the pilot fuel distributor 106, and the stack damper 1084. In one embodiment, the controller 116 is configured to control the actuators 118 to adjust various parameters of the combustion system 1000.

In one embodiment, the controller 116 is configured to output messages, sensor readings, prompts, warnings, alerts, or other types of data on the display 120. An operator of the combustion system 1000 can view the data output on the display 120 and can operate the combustion system 1000 responsive to the data output on the display 120.

In one embodiment, the operator of the combustion system 1000 can utilize the manual controls 123 to operate the components of the combustion system 1000. The manual controls 123 can control the actuators 118 to adjust the parameters of the combustion system 1000. Alternatively, or additionally, the manual controls 123 can enable the operator to physically adjust the components of the combustion system 1000 separate from the actuators 118.

In one embodiment, the control input 670 may enable an operator of the combustion system 1000 to input commands or data to the controller 116. In one embodiment, the controller 116 can output requests for the operator to approve one or more actions proposed by the controller 116 responsive to sensor signals provided by the various sensors. The operator of the combustion system 1000 can input selections or commands approving or disapproving the proposed actions of the controller 116 via the other control inputs 670.

FIG. 10B is a diagram of the combustion system 1000 of FIG. 10A in the preheating state, according to an embodiment. In the preheating state, the combustion system 1000 generates a pilot flame 1075 to preheat the distal flame holder 102 to an operating temperature. When the distal flame holder 102 has been heated to the operating temperature, the combustion system 1000 can transition to the standard operating state.

In one embodiment, in the preheating state the controller 116 controls one or more of the actuators 118 to open the pilot fuel valves 1076. With the pilot fuel valves 1076 open, the pilot fuel source 108 supplies the pilot fuel to the pilot fuel distributor 106. The pilot fuel distributor 106 outputs the pilot fuel into the furnace volume 1073. In one embodiment, the pilot fuel distributor 106 includes one or more pilot fuel nozzles each coupled onto the end of a pilot fuel riser. The pilot fuel is output from orifices in the fuel nozzles.

In one embodiment, in the preheating state the controller 116 controls one or more of the actuators 118 to cause the oxidant source 104 to supply oxidant 1080 into the furnace volume 1073. The oxidant source 104 supplies the oxidant 1080 into the furnace volume 1073. The oxidant 1080 mixes with the pilot fuel in the furnace volume 1073.

In one embodiment, the oxidant source 104 includes a barrel register. The barrel register includes apertures that can be opened to a selected degree in order to draft the oxidant 1080 into the furnace volume 1073. The actuators 118 can control the degree to which the apertures are open, and thus the degree to which the oxidant 1080 is drafted into the furnace volume 1073.

In one embodiment, the controller 116 controls one or more of the actuators 118 to cause the igniter 1077 to ignite the pilot fuel and the oxidant to produce a pilot flame 1075. The controller 116 can cause the igniter 1077 to generate an electric arc capable of igniting the pilot flame 1075 in the presence of the mixed pilot fuel and the oxidant. The electric arc can cause ignition of the pilot fuel and the oxidant, thereby initiating the pilot flame 1075.

In one embodiment, the pilot flame sensor 124 (see FIG. 10A) monitors the parameters of the pilot flame 1075 and provides sensor signals to the controller 116 indicating the sensed parameters of the pilot flame 1075. The pilot flame sensor 124 can sense whether the pilot flame 1075 is present. The pilot flame sensor 124 can also sense the position of the pilot flame 1075. The pilot flame sensor 124 can also sense the temperature of the pilot flame 1075. The pilot flame sensor 124 outputs the sensor signals to the controller 116 indicative of the parameters of the pilot flame 1075.

In one embodiment, the controller 116 can adjust the parameters of the pilot flame 1075 responsive to the sensor signals provided by the pilot flame sensor 124. For example, if the pilot flame sensor 124 signals indicate that the pilot flame 1075 is not present, then the controller 116 can control one or more of the actuators 118 to generate additional electric arcs from the igniter 1077, to adjust the distribution of the pilot fuel into the furnace volume 1073, or to adjust the flow of the oxidant into the furnace volume 1073. The controller 116 can also control the flow of the pilot fuel and the oxidant in order to adjust the position of the pilot flame 1075 responsive to the sensor signals from the pilot flame sensor 124.

In one embodiment, the distal flame holder sensor 122 measures the temperature of the distal flame holder 102 during the preheating state and provides the sensor signals to the controller 116 indicating the temperature of the distal flame holder 102. If the sensor signals from the distal flame holder sensor 122 indicates that the temperature of the distal flame holder 102 is below an operating or threshold temperature, then the controller 116 allows the pilot flame 1075 to continue to heat the distal flame holder 102. If the sensor signals from the distal flame holder sensor 122 indicate that the temperature of the distal flame holder 102 is equal to or greater than the operating or threshold temperature, then the controller 116 can cause the combustion system 1000 to transition to the standard operating state.

In one embodiment, an operator of the combustion system 1000 can activate, operate, or adjust the various components of the combustion system 1000 during the preheating state by operating the manual controls 123. The operator can adjust the parameters of the combustion system 1000 responsive to messages provided by the controller 116 via the display 120.

FIG. 10C is a diagram of the combustion system 1000 in the standard operating state, according to an embodiment. In the standard operating state, the combustion system 1000 sustains a combustion reaction 1086 of at least the main fuel and the oxidant at the distal flame holder 102.

In one embodiment, the combustion system 1000 transitions to the standard operating state by first reducing a flow of the pilot fuel supplying the pilot flame 1075. The controller 116 reduces the pilot flame 1075 by causing one or more of the actuators 118 to reduce flow of the pilot fuel to the pilot flame 1075 via the pilot fuel valves 1076, thereby ceasing the flow of the pilot fuel to the pilot fuel distributor(s) 106. When the pilot fuel distributor(s) 106 cease to output the pilot fuel, the pilot flame 1075 is reduced from a preheating size to a maintenance size.

In an embodiment, the controller 116 causes the combustion system 1000 to enter the standard operating state by causing one or more of the actuators 118 to open the main fuel valves 1074, thereby enabling the main fuel to flow from the main fuel source 112 to the main fuel distributors 110. The main fuel distributors 110 output the main fuel toward the distal flame holder 102. The controller 116 can also cause the oxidant source 104 to output the oxidant into the furnace volume 1073, if the oxidant source 104 is not already outputting the oxidant into the furnace volume 1073. The main fuel entrains and mixes with the oxidant as it travels toward the distal flame holder 102. Because the distal flame holder 102 is at the operating temperature, the distal flame holder 102 ignites and sustains the combustion reaction 1086 of the mixture 206 of the main fuel and the oxidant. In one embodiment, the distal flame holder 102 holds a portion of the combustion reaction 1086 adjacent to the distal flame holder 102. In an embodiment in which the distal flame holder 102 includes a perforated flame holder body (e.g., 208), the distal flame holder 102 can sustain at least a portion of the combustion reaction 1086 within the perforated flame holder body. The distal flame holder 102 may also sustain a portion of the combustion reaction 1086 upstream and/or downstream from the distal flame holder 102.

In one embodiment, in the standard operating state, the distal flame holder sensor 122, the pressure sensor 654, the bridgewall temperature sensor 640, and the gas composition sensor 1072 output sensor signals to the controller 116. The distal flame holder sensor 122 monitors parameters of the combustion reaction 1086, including the position, distribution, and temperature of the combustion reaction 1086. The bridgewall temperature sensor 640 senses the temperature of the bridgewall of the furnace 1071 and the pressure sensor 654 senses the pressure within the furnace volume 1073. The gas composition sensor 1072 senses the concentration of various gases, such as $NO_X$, CO, and $O_2$, in the flue gases 1082 and exit through the flue of the furnace 1071.

In one embodiment, the controller 116 can cause the actuators 118 to adjust the flow of the main fuel, the flow of the oxidant, the orientation of the stack damper 1084, and other components of the combustion system 1000 in order to adjust the parameters of the combustion system 1000. The controller 116 can control the flow of the oxidant and the main fuel, as well as a position of the stack damper 1084 to adjust the concentration of gases in the flue gas 1082, to adjust the location and distribution of the combustion reaction 1086, to adjust the pressure within the furnace volume 1073, or to adjust other parameters of the combustion system 1000.

Figure 11:
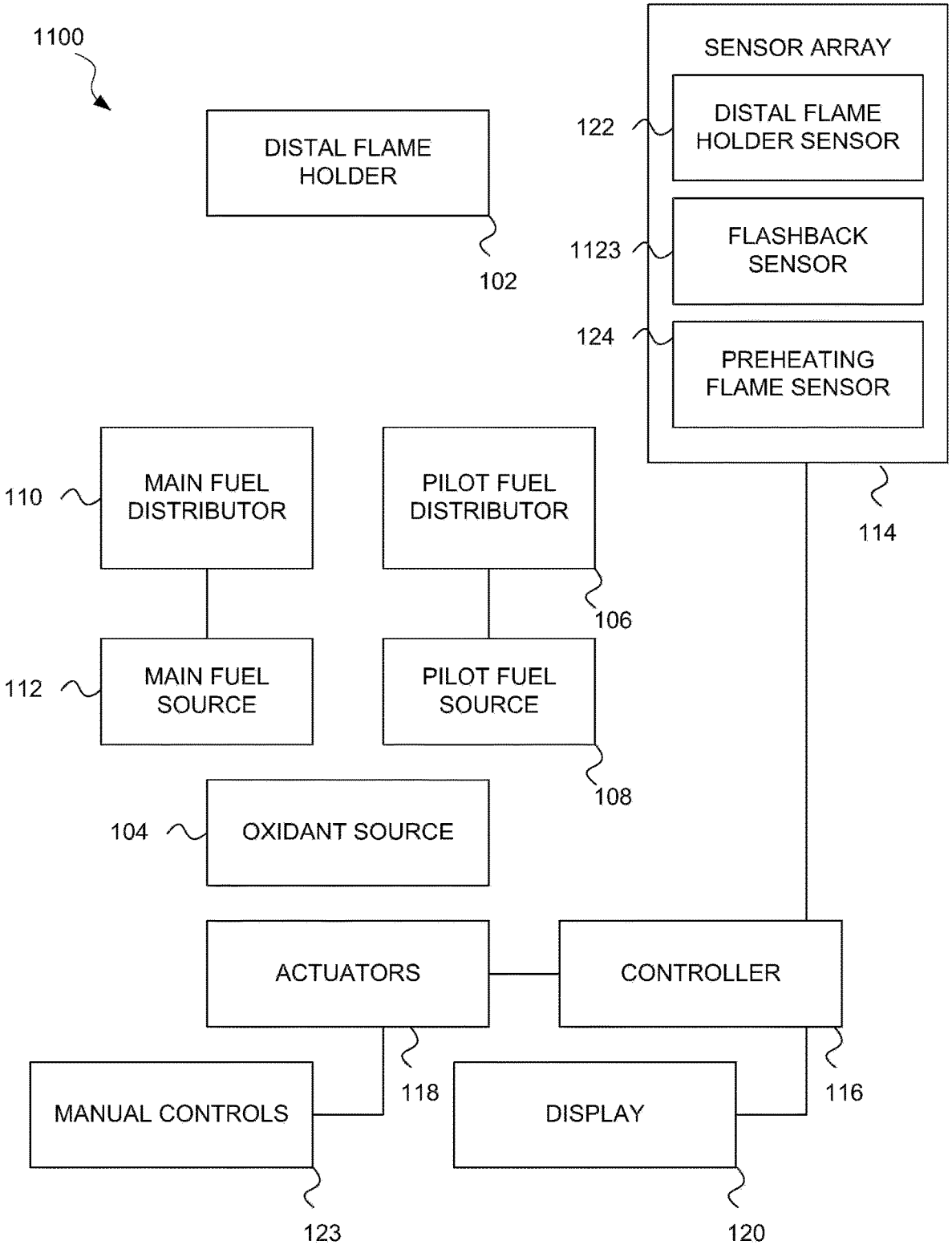
FIG. 11 is a diagram of a combustion system, according to an embodiment.

FIG. 11 is a diagram of a combustion system 1100, according to an embodiment. The combustion system 1100 is substantially similar to the combustion system 100 of FIG. 1, except that the sensor array 114 of the combustion system 1100 may include a flashback sensor 1123. The inventors have found that positioning a variable pilot (e.g., pilot fuel distributor 106) between the main fuel nozzles 110 and the distal flame holder 102 may reduce the incidence of flashback. The inventors have successfully run such systems without flashback sensors. Accordingly, use of a variable pilot may obviate the need for a flashback sensor 1123. Nevertheless, some embodiments may employ the flashback sensor 1123 as follows.

In one embodiment, the flashback sensor 1123 is configured to sense flashback of the combustion reaction held by the distal flame holder 102 toward the main fuel distributor 110 during the standard operating state. Flashback is a potentially dangerous condition in which the combustion reaction travels upstream, igniting the fuel stream closer than desired to the main fuel distributor 110. The flashback sensor 1123 senses the flashback and transmits sensor signals to the controller 116 indicating the presence of the flashback. The controller 116 can then take one or more actions to stop the flashback condition.

In one embodiment, the controller 116 stops the flashback condition by increasing a velocity of the flow of the main fuel from the main fuel distributor 110. The increased velocity of the flow of the main fuel inhibits the combustion reaction from traveling upstream because the fuel travels faster than the combustion reaction can travel upstream. The controller 116 can operate one or more of the actuators 118 to adjust the flow of the main fuel from the main fuel distributor 110 responsive to the sensor signals from the flashback sensor 1123. Alternatively, the controller 116 can output an indication on the display 120 prompting the operator to manually adjust the flow of the main fuel to inhibit the flashback.

In one embodiment, the controller 116 stops the flashback condition by stopping the flow of the main fuel, thereby bringing the combustion system 1100 out of the standard operating state. The controller 116 can operate one or more of the actuators 118 to stop the flow of the main fuel from the main fuel distributor 110 responsive to the sensor signals from the flashback sensor 1123. Alternatively, the controller 116 can output an indication on the display 120 prompting the operator to manually stop the flow of the main fuel to inhibit the flashback. The controller 116 can shut down the combustion system 1100 entirely when the flashback occurs.

In one embodiment, the controller 116 can take other actions than those described above in order to deal with the flashback condition.

In one embodiment, the flashback sensor 1123 senses the flashback during the preheating state of the combustion system 1100. In particular, in the preheating state the flashback sensor 1123 detects a flashback of the pilot flame 1075 toward the pilot fuel distributor 106. The controller 116 can respond to the flashback condition in the preheating state by increasing the flow of the pilot fuel, by stopping the flow of the pilot fuel, or in any other suitable manner.

In one embodiment, the flashback sensor 1123 is positioned to sense flashback between the input face 212 of the distal flame holder 102 and the main fuel distributor 110. Thus, in a vertically fired combustion system 1100, the flashback sensor 1123 can have a vertical position between the distal flame holder 102 and the main fuel distributor 110. In a laterally fired combustion system 1100, the flashback sensor 1123 can have a lateral position between the distal flame holder 102 and the main fuel distributor 110.

In one embodiment, the flashback sensor 1123 can include one or more of a camera, an infrared sensor, a flame rod, a UV sensor, a CCD camera, thermocouples, photo cells, electrodes, or other kinds of devices capable of sensing flashback.

Figure 12:
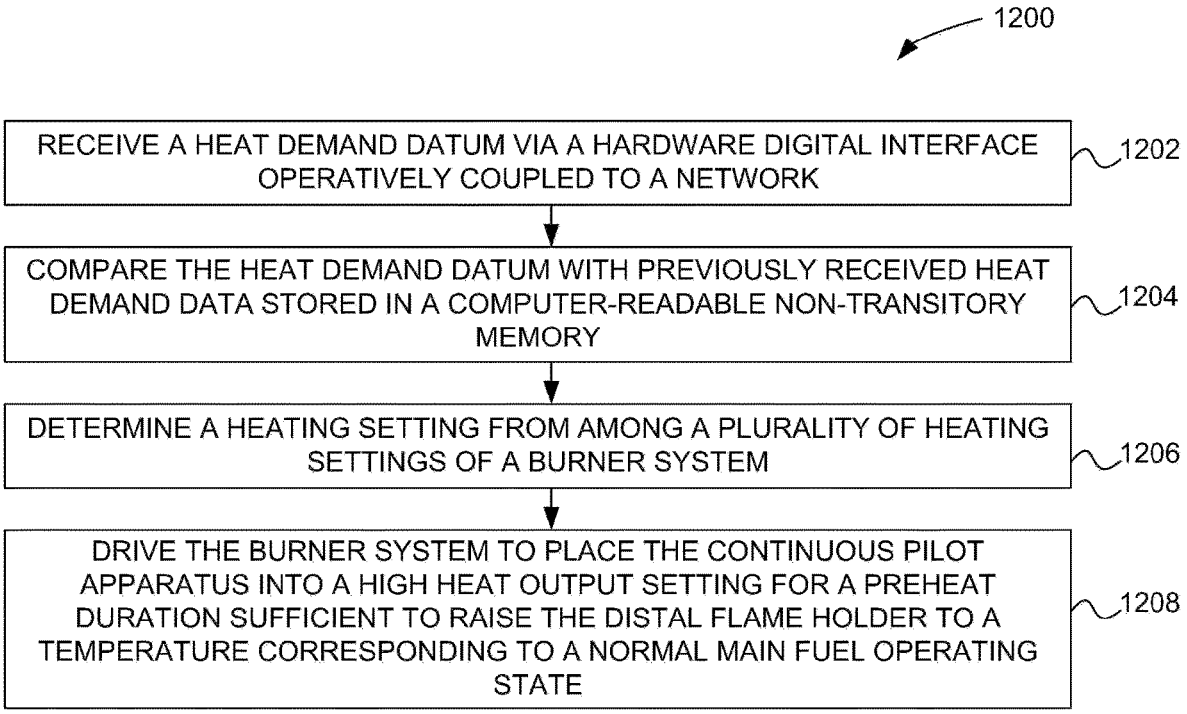
FIG. 12 is a flow chart showing a computer method for operating a burner system having at least one distal flame holder and at least one continuous pilot apparatus, according to an embodiment.

FIG. 12 is a flow chart showing a computer method 1200 for operating a burner system having at least one distal flame holder and at least one continuous pilot apparatus, according to an embodiment. Computer method 1200 corresponds to a preheating procedure that prepares a distal flame holder (e.g., 102) to carry sufficient heat to ignite the main fuel and oxidant flowing thereto.

According to an embodiment, a computer method 1200 for operating a burner having at least one distal flame holder and at least one continuous pilot apparatus includes, in step 1202, receiving a heat demand datum via a hardware digital interface operatively coupled to a network. Step 1204 includes comparing, using a logic device, the heat demand datum with previously received heat demand data stored in a computer-readable non-transitory memory. Step 1206 includes determining, with the logic device and the computer-readable non-transitory memory, as a function of the heat demand datum, a heating setting from among a plurality of heating settings of the burner system. Step 1208 includes, responsive to an increase in the heat demand datum compared to previously received heat demand data, driving the burner system to place the continuous pilot apparatus into a high heat output setting, of the plurality of heating settings, for a preheat duration sufficient to raise the distal flame holder to a temperature corresponding to a normal main fuel operating state.

According to an embodiment, in step 1206, the plurality of heating settings of the burner system includes one or more positions corresponding to each of a plurality of fuel flow control valves, a first fuel flow control valve of the plurality of fuel flow control valves being operatively coupled to the continuous pilot apparatus, and a second fuel flow control valve of the plurality of fuel flow control valves being operatively coupled to the one or more main fuel nozzles.

According to an embodiment, in step 1206, the plurality of heating settings of the burner system includes a plurality of positions corresponding to each of the plurality of fuel flow control valves, a first subset of the plurality of fuel flow control valves being operatively coupled to the continuous pilot apparatus, and a second subset of the plurality of fuel flow control valves each being operatively coupled to a respective main fuel nozzle of the one or more main fuel nozzles.

According to an embodiment, the computer method 1200 for operating a burner system having at least one distal flame holder and at least one continuous pilot apparatus further includes (not illustrated) receiving sensor data substantially determinate that the distal flame holder has reached the temperature corresponding to the normal main fuel operating state. The determination that the distal flame holder has reached the temperature corresponding to the normal main fuel operating state is performed by the logic device and the non-transitory computer memory as a function of the received sensor data. In an alternative, or additional embodiment, the computer method 1200 for operating a burner system having at least one distal flame holder and at least one continuous pilot apparatus further includes (not illustrated) receiving a preheat time clock datum corresponding to expiration of the preheat duration.

Figure 13:
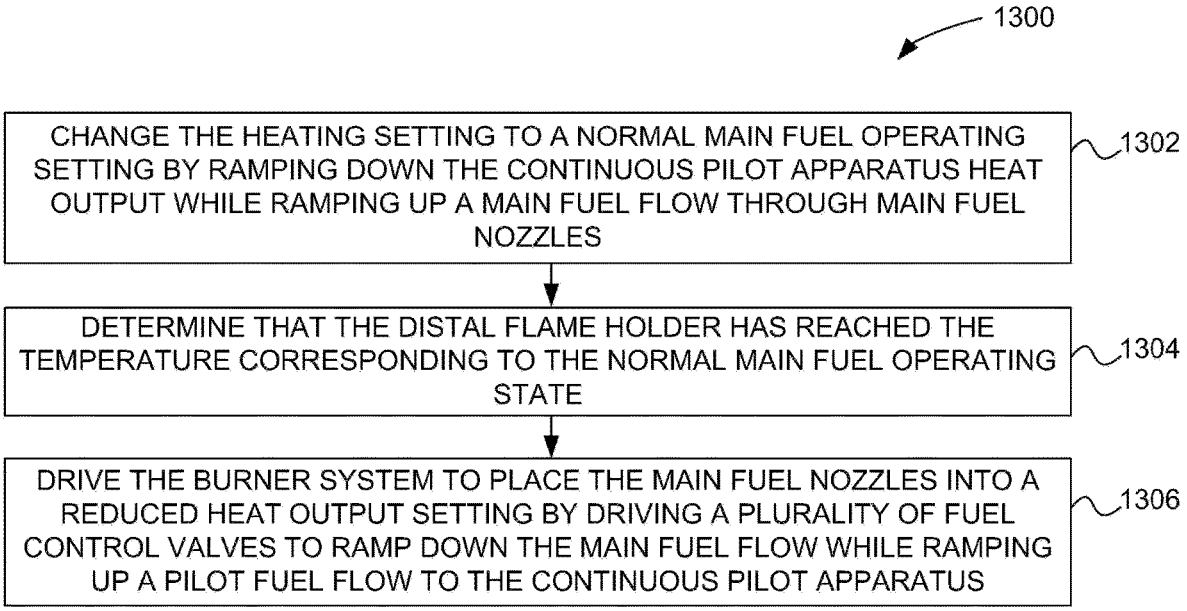
FIG. 13 is a flow chart showing a computer method for operating a burner system having at least one distal flame holder and at least one continuous pilot apparatus, according to an embodiment.

FIG. 13 is a flow chart showing a computer method 1300 for operating a burner system having at least one distal flame holder and at least one continuous pilot apparatus, according to an embodiment. Step 1302 includes changing the heating setting to a normal main fuel operating setting by ramping down the at least one continuous pilot apparatus heat output while ramping up a main fuel flow through one or more main fuel nozzles aligned to output a main fuel for entrainment in combustion air, and for entrance to an input face of at least one tile of the distal flame holder.

Step 1304 includes determining, with the logic device and the computer-readable non-transitory memory, as a function of the preheat time clock datum, that the distal flame holder has reached the temperature corresponding to the normal main fuel operating state.

In an embodiment, the heat demand datum corresponds to a capacity requirement proportional to completely burning a fuel at a given flow rate of the fuel. In another embodiment, the fuel is the main fuel output through the main fuel nozzles.

According to an embodiment, the computer method 1300 for operating a burner system having at least one distal flame holder and at least one continuous pilot apparatus further includes, in step 1306, responsive to a second received heat demand datum compared to previously received heat demand data, driving the burner system to place one or more main nozzles into a reduced heat output setting, of the plurality of heating settings, by driving a plurality of fuel control valves to ramp down the main fuel flow while ramping up a pilot fuel flow to the continuous pilot apparatus. The comparison of the second received heat demand datum to the previously received heat demand data may be performed with the logic device and the non-transitory computer memory.

In an embodiment, the normal main fuel operating setting includes a ratio of pilot fuel flow to main fuel flow corresponding to a particular heat demand datum. The ratio of pilot fuel flow to main fuel flow corresponding to the particular heat demand datum may be a function of previous heat demand data.

Those of skill in the art will recognize, in light of the present disclosure, that the combustion system in accordance with principles of the present disclosure can include sensors and actuators other than those disclosed herein, other combinations of sensors and actuators, as well as other kinds of actions to be taken by the controller 116 responsive to sensor signals. All such other sensors, actuators, combinations, and actions fall within the scope of the present disclosure.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a pilot fuel distributor configured to support a pilot flame by outputting a pilot fuel into a furnace volume at least during a preheating state;

a main fuel distributor configured to output a main fuel into the furnace volume during a standard operating state;

a distal flame holder positioned in the furnace volume to be preheated by the pilot flame during the preheating state and to support a combustion reaction of the main fuel and an oxidant at least adjacent to the distal flame holder during the standard operating state;

a pilot flame sensor configured to sense a condition of the pilot flame and to output a sensor signal indicative of the condition of the pilot flame;

a distal flame holder sensor configured to sense a condition of the distal flame holder and to generate a sensor signal indicative of the condition of the distal flame holder;

one or more actuators configured to adjust a flow of the main fuel from the main fuel distributor and to adjust a flow of the pilot fuel from the pilot fuel distributor; and a controller communicatively coupled to the actuators, the pilot flame sensor, and the distal flame holder sensor, the controller being configured to receive the sensor signals from the pilot flame sensor and the distal flame holder sensor and to control the actuators to adjust the flow of the pilot fuel and the main fuel responsive to the sensor signals and in accordance with software instructions stored in a non-transitory computer readable medium coupled to the controller.

2. The combustion system of claim 1, wherein the distal flame holder includes a perforated flame holder configured to support the combustion reaction of the main fuel and the oxidant at least partially within the perforated flame holder during the standard operating state.

3. The combustion system of claim 1, wherein the distal flame holder includes at least one solid refractory tile.

4. The combustion system of claim 1, further comprising:

an oxidant source configured to provide the oxidant to the furnace volume; and one or more actuators communicatively coupled to the controller configured to adjust a flow of the oxidant from the oxidant source;

wherein the controller is configured to control the one or more actuators to adjust the flow of the oxidant responsive to the received sensor signals.

5. The combustion system of claim 1, wherein the pilot flame sensor includes an electro capacitive flame sensor.

6. The combustion system of claim 1, further comprising an igniter configured to generate an electric arc capable of igniting the pilot fuel, and wherein the controller is configured to control one or more of the actuators to cause the igniter to generate the electric arc to ignite the pilot flame if the pilot flame sensor indicates that the pilot flame is not present and all safety interlocks are satisfied.

7. The combustion system of claim 1, wherein the controller is configured to adjust a position of the pilot flame in response to the sensor signals from the pilot flame sensor by controlling one or more of the actuators to adjust the flow of the pilot fuel or the oxidant.

8. The combustion system of claim 1, further comprising at least one of:

a CO monitor sensor configured to sense a concentration of CO in flue gases generated by the combustion reaction and to output sensor signals to the controller indicative of a concentration of CO in the flue gases, a $NO_X$ monitor sensor configured to sense a concentration of $NO_X$ in the flue gases generated by the combustion reaction and to output sensor signals to the controller indicative of the concentration of $NO_X$ in the flue gases; and an $O_2$ monitor sensor configured to sense a concentration of $O_2$ in the flue gases generated by the combustion reaction and to output sensor signals to the controller indicative of the concentration of $O_2$ in the flue gases.

9. The combustion system of claim 8, wherein the controller is configured to control the actuators to adjust at least one of the flow of the main fuel and the flow of the oxidant if the sensor signals indicate a higher than acceptable concentration of CO or $NO_X$ in the flue gases or a concentration of $O_2$ in the flue gasses outside an acceptable range.

10. The combustion system of claim 9, wherein to adjust the flow of the main fuel includes one or more of:

adjusting a flow rate of the main fuel; and adjusting a fuel blend of the main fuel.

11. The combustion system of claim 1, wherein the distal flame holder sensor includes a distal flame holder flame scanner configured to sense a condition of a combustion reaction of the main fuel and the oxidant and to output sensor signals indicative of the condition of the combustion reaction.

12. The combustion system of claim 11, wherein the controller is configured to receive the sensor signals from the distal flame holder flame scanner and to cause the actuators to adjust one or more of the flow of the main fuel and a flow of the oxidant responsive to the condition of the combustion reaction.

13. The combustion system of claim 1, further comprising a process monitor configured to sense a condition of a process that receives heat from the combustion reaction and to output sensor signals indicative of the condition of the process.

14. The combustion system of claim 13, wherein the controller is configured to receive the sensor signals from the process monitor and to cause the actuators to adjust one or more of the flow of the main fuel and the flow of the oxidant responsive to the condition of the process.

15. The combustion system of claim 1, further comprising a pressure sensor configured to sense a pressure in the furnace volume and to output sensor signals indicative of the pressure.

16. The combustion system of claim 15, wherein the pressure sensor includes one or more of a pressure change microphone, a static pressure sensor, a dynamic pressure sensor, and a differential pressure sensor.

17. The combustion system of claim 16, wherein the controller is configured to receive the sensor signals from the pressure sensor and to cause the actuators to adjust one or more of a flow of the oxidant, the flow of the main fuel, or a stack damper responsive to the condition of the process.

18. The combustion system of claim 1, wherein the distal flame holder sensor includes a distal flame holder temperature sensor configured to sense a temperature of the distal flame holder and to output sensor signals indicative of the temperature of the distal flame holder.

19. The combustion system of claim 18, wherein the controller is configured to receive the sensor signals from the distal flame holder temperature sensor and to cause the actuators to adjust one or more of the flow of the main fuel, a flow of the oxidant, or position of a stack damper responsive to the condition of the process.

20. The combustion system of claim 18, wherein the controller is configured to control one or more of the actuators to heat the distal flame holder if the sensor signals from the distal flame holder temperature sensor indicate that the temperature of the distal flame holder has dropped below an operational temperature.

21. The combustion system of claim 18, wherein the controller is configured to control one or more of the actuators to transition from the preheating state to the standard operating state if the sensor signals from the distal flame holder temperature sensor indicate that the temperature of the distal flame holder has reached at least a predetermined operating temperature.

22. The combustion system of claim 21, wherein the controller causes the transition from the preheating state to the standard operating state by controlling the actuators to cease the flow of the pilot fuel and to initiate the flow of the main fuel.

23. The combustion system of claim 1, further comprising:

manual controls configured to enable an operator to manually manipulate one or more of an oxidant source configured to supply the oxidant, a pilot fuel source configured to supply the pilot fuel, and a main fuel source configured to supply the main fuel, and control inputs configured to enable an operator to input data or commands to the controller.

24. The combustion system of claim 1, further comprising a flashback sensor configured to detect flashback of the combustion reaction from the distal flame holder toward the main fuel distributor and to output sensor signals to the controller indicating the occurrence of the flashback, and wherein the controller is configured to operate one or more of the actuators to inhibit the flashback responsive to the sensor signals from the flashback sensor.

25. The combustion system of claim 1, wherein the controller is configured to operate one or more of the actuators to adjust a turndown ratio associated with the distal flame holder.

26. The combustion system of claim 1, wherein the pilot fuel distributor includes a fuel nozzle disposed proximate to the main fuel distributor; and wherein the controller is configured to cause the flow of the pilot fuel to stop and the flow of the main fuel to start when the distal flame holder is determined to be at a predetermined operating temperature.

27. The combustion system of claim 1, wherein the pilot fuel distributor includes a pilot flame support assembly disposed distal from the main fuel distributor, at a distance intermediate between the main fuel distributor and the distal flame holder; and wherein the controller is configured to cause the flow of the pilot fuel to decrease so as to maintain the pilot flame supported by the pilot flame support assembly and the flow of the main fuel to start when the distal flame holder is determined to be at a predetermined operating temperature.

28. The combustion system of claim 1, wherein the pilot fuel distributor is further configured to support the pilot flame by continuously outputting the pilot fuel via the pilot fuel distributor at selectable flow rates during both the preheating state and the standard operating state.

29. The combustion system of claim 28, wherein the rate of the flow of the pilot fuel output by the pilot fuel distributor during the preheating state is greater than the rate of the flow of the pilot fuel output by the pilot fuel distributor during the standard operating state.

30. The combustion system of claim 1, further comprising:

an oxidant source configured to output an oxidant into a furnace volume;

a display; wherein the controller is further communicatively coupled to the display and is further configured to output data on the display prompting a technician to adjust one or more of a flow of the pilot fuel, a flow of the main fuel, and a flow of the oxidant, via the one or more actuators, based on the sensor signals and in accordance with software instructions stored in a non-transitory computer readable medium coupled to the controller.

31. The combustion system of claim 30, further comprising an actuator configured to adjust a position of a stack damper.

32. The combustion system of claim 31, further comprising manual controls configured to enable the technician to operate the actuators to adjust the one or more of the flow of the pilot fuel, the flow of the main fuel, the flow of the oxidant, and the position of the stack damper.

33. A computing system implemented method for operating a combustion system, the method comprising:

receiving, during a preheating state of a combustion system, sensor signals from a pilot flame sensor indicating a condition of a pilot flame in a furnace volume supported by a flow of pilot fuel and an oxidant;

receiving, during the preheating state, sensor signals from a distal flame holder sensor indicating a temperature of a distal flame holder positioned in the furnace volume to be preheated to an operating temperature by the pilot flame during the preheating state;

outputting control signals to control one or more actuators to adjust a flow of the pilot fuel, to adjust a flow of the oxidant, or to generate an electric arc to ignite the pilot flame responsive to the sensor signals from the pilot flame sensor and in accordance with software instructions stored on a non-transitory computer readable medium;

outputting control signals to control one or more actuators to transition the combustion system from the preheating state to a standard operating state if the sensor signals from the distal flame holder sensor indicate that the distal flame holder has reached the operating temperature, the standard operating state corresponding to supporting a combustion reaction of a main fuel and the oxidant in the distal flame holder and in accordance with the software instructions stored on the non-transitory computer readable medium;

receiving sensor signals from the distal flame holder sensor during the standard operating state indicating a condition of the distal flame holder; and outputting control signals to control one or more actuators to adjust a flow of the main fuel or to adjust the flow of the oxidant responsive to the sensor signals from the distal flame holder sensor during the standard operating state and in accordance with the software instructions stored on the non-transitory computer readable medium.

34. The computing system implemented method of claim 33, further comprising outputting control signals to shut down the combustion system if the sensor signals indicate a fault condition.

35. A system for controlling a combustion system, the system comprising:

at least one processor; and at least one memory coupled to the at least one processor, the at least one memory having stored therein instructions which, when executed by any set of the one or more processors, perform a process including:

causing the combustion system to enter a preheating state by controlling one or more actuators to initiate a pilot flame supported by a flow of pilot fuel and an oxidant and configured to preheat a distal flame holder to an operating temperature;

receiving sensor signals from a pilot flame sensor indicating a condition of the pilot flame;

receiving sensor signals from a distal flame holder sensor indicating a condition of the distal flame holder;

controlling the one or more actuators to adjust the flow of the pilot fuel, to adjust a flow of the oxidant, or to activate an igniter if the sensor signals from the pilot flame sensor indicate a predetermined condition of the pilot flame;

causing the combustion system to transition from the preheating state to a standard operating state, if the sensor signals from the distal flame holder sensor indicate that the distal flame holder has reached the operating temperature, by controlling the one or more actuators to stop the flow of the pilot fuel and to initialize a flow of a main fuel, the distal flame holder being configured to support a combustion reaction of the main fuel and the oxidant during the standard operating state; and controlling the one or more actuators to adjust the flow of main fuel or to adjust the flow of the oxidant if the sensor signals indicate a predetermined condition of the distal flame holder or the combustion reaction.

36. The system of claim 35, wherein the process further includes causing the one or more actuators to initiate heating of the distal flame holder by increasing the flow of the pilot fuel to the pilot flame if the sensor signals indicate that the distal flame holder has dropped below the operating temperature during the standard operating state.

37. The system of claim 35, wherein the process further includes outputting messages on a display prompting an operator of the combustion system to approve the controlling of the actuators to transition to the standard operating state, to adjust the flow of the oxidant or the pilot fuel in the preheating state, or to adjust the flow of the oxidant or the main fuel during the standard operating state.

38. A computer method for operating a burner system having at least one distal flame holder and at least one continuous pilot apparatus, the method comprising:

receiving a heat demand datum via a hardware digital interface operatively coupled to a network;

comparing, using a logic device, the heat demand datum with previously received heat demand data stored in a computer-readable non-transitory memory;

determining, with the logic device and the computer-readable non-transitory memory, as a function of the heat demand datum, a heating setting from among a plurality of heating settings of the burner system;

responsive to an increase in the heat demand datum compared to previously received heat demand data, driving the burner system to place the continuous pilot apparatus into a high heat output setting, of the plurality of heating settings, for a preheat duration sufficient to raise the distal flame holder to a temperature corresponding to a normal main fuel operating state; and after the temperature corresponding to the normal main fuel operating state has been reached, changing the heating setting to a normal main fuel operating setting by ramping down the at least one continuous pilot apparatus heat output while ramping up a main fuel flow through one or more main fuel nozzles aligned to output a main fuel for entrainment in combustion air, and for entrance to an input face of at least one tile of the distal flame holder.

39. The computer method of claim 38, wherein the plurality of heating settings of the burner system comprise one or more positions corresponding to each of a plurality of fuel flow control valves, a first fuel flow control valve of the plurality of fuel flow control valves being operatively coupled to the continuous pilot apparatus, and a second fuel flow control valve of the plurality of fuel flow control valves being operatively coupled to the one or more main fuel nozzles.

40. The computer control method of claim 39, wherein the plurality of heating settings of the burner system comprise a plurality of positions corresponding to each of the plurality of fuel flow control valves, a first subset of the plurality of fuel flow control valves being operatively coupled to the continuous pilot apparatus, and a second subset of the plurality of fuel flow control valves each being operatively coupled to a respective main fuel nozzle of the one or more main fuel nozzles.

41. The computer method of claim 38, further comprising:

receiving sensor data substantially determinate that the distal flame holder has reached the temperature corresponding to the normal main fuel operating state;

wherein the determination that the distal flame holder has reached the temperature corresponding to the normal main fuel operating state is performed by the logic device and the non-transitory computer memory as a function of the received sensor data.

42. The computer method of claim 38, further comprising:

receiving a preheat time clock datum corresponding to expiration of the preheat duration; and determining, with the logic device and the computer-readable non-transitory memory, as a function of the preheat time clock datum, that the distal flame holder has reached the temperature corresponding to the normal main fuel operating state.

43. The computer method of claim 38, wherein the heat demand datum corresponds to a capacity requirement proportional to completely burning a fuel at a given flow rate of the fuel.

44. The computer method of claim 43, wherein the fuel is the main fuel output through the main fuel nozzles.

45. The computer method of claim 38, further comprising:

responsive to a second received heat demand datum compared to previously received heat demand data, driving the burner system to place the one or more main nozzles into a reduced heat output setting, of the plurality of heating settings, by driving a plurality of fuel control valves to ramp down the main fuel flow while ramping up a pilot fuel flow to the continuous pilot apparatus, wherein the comparison of the second received heat demand datum to the previously received heat demand data is performed with the logic device and the non-transitory computer memory.

46. The computer method of claim 38, wherein the normal main fuel operating setting includes a ratio of pilot fuel flow to main fuel flow corresponding to a particular heat demand datum.

47. The computer method of claim 46, wherein the ratio of pilot fuel flow to main fuel flow corresponding to the particular heat demand datum is a function of previous heat demand data.

* * * * *